US010308040B2

(12) United States Patent
Oya

(10) Patent No.: US 10,308,040 B2
(45) Date of Patent: Jun. 4, 2019

(54) IMAGE PROCESSING APPARATUS, IMAGE PROCESSING METHOD, AND STORAGE MEDIUM

(71) Applicant: CANON KABUSHIKI KAISHA, Tokyo (JP)

(72) Inventor: Masashi Oya, Soka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/708,738

(22) Filed: Sep. 19, 2017

(65) Prior Publication Data

US 2018/0086113 A1 Mar. 29, 2018

(30) Foreign Application Priority Data

Sep. 29, 2016 (JP) ..... 2016-191587

(51) Int. Cl.
*B41J 2/21* (2006.01)
*B41J 11/00* (2006.01)

(52) U.S. Cl.
CPC ..... *B41J 11/0015* (2013.01); *B41J 2/2114* (2013.01); *G03G 2215/0081* (2013.01); *G03G 2215/00805* (2013.01)

(58) Field of Classification Search
None
See application file for complete search history.

(56) References Cited

U.S. PATENT DOCUMENTS

2014/0333707 A1* 11/2014 Hozumi ..... B41J 2/32 347/183
2015/0029520 A1* 1/2015 Itoh ..... G03G 15/5062 358/1.1

FOREIGN PATENT DOCUMENTS

| | | | |
|---|---|---|---|
| CN | 102189784 | A | 9/2011 |
| CN | 105082753 | A | 11/2015 |
| JP | 2015-094826 | A | 5/2015 |
| JP | 2016-092650 | A | 5/2016 |

* cited by examiner

*Primary Examiner* — Henok D Legesse
(74) *Attorney, Agent, or Firm* — Canon USA, Inc., IP Division

(57) ABSTRACT

An image processing apparatus includes a first obtaining unit obtaining color signals representing colors of an image, a second obtaining unit obtaining a gloss signal representing image gloss, a third obtaining unit obtaining a predetermined amount of a recording material, a first determination unit determining a recording amount of glossy recording material recorded in a first region, a second determination unit determining recording amounts of colored recording materials recorded in the first region such that a total amount of the recording amount of the glossy recording material recorded in the first region and the recording amounts of the colored recording materials recorded in the first region does not exceed the predetermined amount, and a third determination unit determining recording amounts of colored recording materials recorded in a second region based on the color signals and the recording amounts of the colored recording materials.

23 Claims, 19 Drawing Sheets

FIG. 3

205

| COLOR SIGNAL | | | VIRTUAL INK AMOUNT | | |
|---|---|---|---|---|---|
| R | G | B | Vc | Vm | Vy |
| 0 | 0 | 0 | 180 | 160 | 160 |
| 0 | 0 | 16 | 180 | 180 | 140 |
| 0 | 0 | 32 | 190 | 190 | 120 |
| ⋮ | ⋮ | ⋮ | ⋮ | ⋮ | ⋮ |
| 255 | 255 | 240 | 10 | 10 | 5 |
| 255 | 255 | 255 | 0 | 0 | 0 |

207

| GLOSS (Gloss) | CLEAR INK AMOUNT (CL) | DOT PLACEMENT OF CLEAR INK |
|---|---|---|
| 0 | 200 | PLACEMENT A (1402a) |
| 16 | 180 | PLACEMENT A (1402a) |
| 32 | 160 | PLACEMENT A (1402a) |
| ⋮ | ⋮ | ⋮ |
| 240 | 20 | PLACEMENT A (1402a) |
| 255 | 0 | PLACEMENT A (1402a) |

207

| REFLECTION INTENSITY (Gloss) | METALLIC INK AMOUNT (ME) | DOT PLACEMENT OF METALLIC INK |
|---|---|---|
| 0 | 0 | PLACEMENT A (1601a) |
| 16 | 50 | PLACEMENT A (1601a) |
| 32 | 100 | PLACEMENT A (1601a) |
| ⋮ | ⋮ | ⋮ |
| 240 | 180 | PLACEMENT A (1601a) |
| 255 | 200 | PLACEMENT A (1601a) |

207

| REFLECTION DIRECTION (Gloss) | CLEAR INK AMOUNT (CL) | DOT PLACEMENT OF CLEAR INK |
|---|---|---|
| 0 | 200 | PLACEMENT A (1702a) |
| ⋮ | ⋮ | ⋮ |
| 16 | 200 | PLACEMENT B (1702b) |
| ⋮ | ⋮ | ⋮ |
| 32 | 200 | PLACEMENT C (1702c) |
| ⋮ | ⋮ | ⋮ |
| 240 | 200 | PLACEMENT D (1702d) |
| ⋮ | ⋮ | ⋮ |
| 255 | 200 | PLACEMENT A (1702a) |

FIG. 9A

205

| COLOR SIGNAL + GLOSS SIGNAL | | | | ACTUAL INK AMOUNT_300 dpi | | | | | |
|---|---|---|---|---|---|---|---|---|---|
| R | G | B | Gloss | $C_1$ | $M_1$ | $Y_1$ | $K_1$ | $CL_1$ | CLEAR INK DOT PLACEMENT |
| 0 | 0 | 0 | 0 | 0 | 0 | 0 | 150 | 200 | PLACEMENT A (1402a) |
| ⋮ | ⋮ | ⋮ | ⋮ | ⋮ | ⋮ | ⋮ | ⋮ | ⋮ | ⋮ |
| 255 | 255 | 255 | 0 | 0 | 0 | 0 | 0 | 200 | PLACEMENT A (1402a) |
| 0 | 0 | 0 | 16 | 0 | 0 | 0 | 170 | 180 | PLACEMENT A (1402a) |
| ⋮ | ⋮ | ⋮ | ⋮ | ⋮ | ⋮ | ⋮ | ⋮ | ⋮ | ⋮ |
| 255 | 255 | 255 | 16 | 0 | 0 | 0 | 0 | 180 | PLACEMENT A (1402a) |
| ⋮ | ⋮ | ⋮ | ⋮ | ⋮ | ⋮ | ⋮ | ⋮ | ⋮ | ⋮ |
| 0 | 0 | 0 | 255 | 0 | 0 | 0 | 200 | 0 | PLACEMENT A (1402a) |
| ⋮ | ⋮ | ⋮ | ⋮ | ⋮ | ⋮ | ⋮ | ⋮ | ⋮ | ⋮ |
| 255 | 255 | 255 | 255 | 0 | 0 | 0 | 0 | 0 | PLACEMENT A (1402a) |

FIG. 9B

207

| COLOR SIGNAL + GLOSS SIGNAL | | | | ACTUAL INK AMOUNT_300 dpi | | | |
|---|---|---|---|---|---|---|---|
| R | G | B | Gloss | $C_2$ | $M_2$ | $Y_2$ | $K_2$ |
| 0 | 0 | 0 | 0 | 0 | 0 | 0 | 250 |
| ⋮ | ⋮ | ⋮ | ⋮ | ⋮ | ⋮ | ⋮ | ⋮ |
| 255 | 255 | 255 | 0 | 0 | 0 | 0 | 0 |
| 0 | 0 | 0 | 16 | 0 | 0 | 0 | 230 |
| ⋮ | ⋮ | ⋮ | ⋮ | ⋮ | ⋮ | ⋮ | ⋮ |
| 255 | 255 | 255 | 16 | 0 | 0 | 0 | 0 |
| ⋮ | ⋮ | ⋮ | ⋮ | ⋮ | ⋮ | ⋮ | ⋮ |
| 0 | 0 | 0 | 255 | 0 | 0 | 0 | 200 |
| ⋮ | ⋮ | ⋮ | ⋮ | ⋮ | ⋮ | ⋮ | ⋮ |
| 255 | 255 | 255 | 255 | 0 | 0 | 0 | 0 |

FIG. 11A

C SIGNAL

| | | | |
|---|---|---|---|
| 0 | 0 | 0 | 0 |
| 0 | 0 | 0 | 0 |
| 0 | 0 | 0 | 0 |
| 0 | 0 | 0 | 0 |

M SIGNAL

| | | | |
|---|---|---|---|
| 0 | 0 | 0 | 0 |
| 0 | 0 | 0 | 0 |
| 0 | 0 | 0 | 0 |
| 0 | 0 | 0 | 0 |

Y SIGNAL

| | | | |
|---|---|---|---|
| 0 | 0 | 0 | 0 |
| 0 | 0 | 0 | 0 |
| 0 | 0 | 0 | 0 |
| 0 | 0 | 0 | 0 |

K SIGNAL

| | | | |
|---|---|---|---|
| 150 | 0 | 150 | 0 |
| 0 | 150 | 0 | 150 |
| 150 | 0 | 150 | 0 |
| 0 | 150 | 0 | 150 |

CL SIGNAL

| | | | |
|---|---|---|---|
| 160 | 0 | 160 | 0 |
| 0 | 160 | 0 | 160 |
| 160 | 0 | 160 | 0 |
| 0 | 160 | 0 | 160 |

FIG. 11B

C SIGNAL

| | | | |
|---|---|---|---|
| 0 | 0 | 0 | 0 |
| 0 | 0 | 0 | 0 |
| 0 | 0 | 0 | 0 |
| 0 | 0 | 0 | 0 |

M SIGNAL

| | | | |
|---|---|---|---|
| 0 | 0 | 0 | 0 |
| 0 | 0 | 0 | 0 |
| 0 | 0 | 0 | 0 |
| 0 | 0 | 0 | 0 |

Y SIGNAL

| | | | |
|---|---|---|---|
| 0 | 0 | 0 | 0 |
| 0 | 0 | 0 | 0 |
| 0 | 0 | 0 | 0 |
| 0 | 0 | 0 | 0 |

K SIGNAL

| | | | |
|---|---|---|---|
| 0 | 250 | 0 | 250 |
| 250 | 0 | 250 | 0 |
| 0 | 250 | 0 | 250 |
| 250 | 0 | 250 | 0 |

FIG. 11C

C SIGNAL

| | | | |
|---|---|---|---|
| 0 | 0 | 0 | 0 |
| 0 | 0 | 0 | 0 |
| 0 | 0 | 0 | 0 |
| 0 | 0 | 0 | 0 |

M SIGNAL

| | | | |
|---|---|---|---|
| 0 | 0 | 0 | 0 |
| 0 | 0 | 0 | 0 |
| 0 | 0 | 0 | 0 |
| 0 | 0 | 0 | 0 |

Y SIGNAL

| | | | |
|---|---|---|---|
| 0 | 0 | 0 | 0 |
| 0 | 0 | 0 | 0 |
| 0 | 0 | 0 | 0 |
| 0 | 0 | 0 | 0 |

K SIGNAL

| | | | |
|---|---|---|---|
| 150 | 250 | 150 | 250 |
| 250 | 150 | 250 | 150 |
| 150 | 250 | 150 | 250 |
| 250 | 150 | 250 | 150 |

CL SIGNAL

| | | | |
|---|---|---|---|
| 160 | 0 | 160 | 0 |
| 0 | 160 | 0 | 160 |
| 160 | 0 | 160 | 0 |
| 0 | 160 | 0 | 160 |

IMAGE PROCESSING APPARATUS, IMAGE PROCESSING METHOD, AND STORAGE MEDIUM

BACKGROUND

Field of the Disclosure

The present disclosure generally relates to image processing, and more particularly, to an image processing apparatus, an image processing method, a storage medium, and an image processing technique of reproducing color and gloss of a recorded matter.

Description of the Related Art

In recent years, a demand for unique printouts of high quality is increased in a field of commercial printing. To realize the unique printouts of high quality, a technique of controlling gloss of a printed matter using ink, such as a clear ink or a metallic ink has been used. For example, the gloss may be controlled by adjusting heights of roughness to be formed on a surface of the printed manner using a clear ink. On the other hand, when a surface effect, such as gloss, is given to an image, an image in a region in which an effective region and a region using colored recording materials overlap with each other may be different from an image of a region in which only colored recording materials are used for recording in terms of a color. Japanese Patent Laid-Open No. 2015-94826 discloses a technique of determining amounts of colored recording materials to be recorded in accordance with gloss and reducing a change of a color caused by a difference of gloss.

However, an amount of recording material which may be used for recording is limited for each recording medium. If an amount of glossy recording material is increased to enlarge a range of reproduction of gloss, an amount of colored recording material which may be used for recording is reduced. Therefore, according to the technique disclosed in Japanese Patent Laid-Open No. 2015-94826, a certain amount of colored recording material for reproduction of a desired color may not be used for recording in a region in which a large amount of glossy recording material is used. On the other hand, a certain amount of glossy recording material for reproducing desired gloss may not be used for recording in a region in which a large amount of colored recording material is used. Specifically, in the technique disclosed in Japanese Patent Laid-Open No. 2015-94826, enlargement of a range in which gloss is reproduced and reduction of a color difference between color which is actually reproduced and color to be reproduced which occurs due to control of gloss may not go together.

SUMMARY

The present disclosure provides one or more aspects of a process of realizing both of enlargement of a range of reproduction of gloss and reduction of a color difference between color actually reproduced and color to be reproduced caused by controlling the gloss.

According to one or more aspects of the present disclosure, an image processing apparatus generates data for forming an image. The image processing apparatus includes a first obtaining unit configured to obtain color signals representing colors of the image, a second obtaining unit configured to obtain a gloss signal representing gloss of the image, a third obtaining unit configured to obtain a predetermined amount of a recording material, a first determination unit configured to determine a recording amount of glossy recording material to be recorded in a first region of the image based on the gloss signal, a second determination unit configured to determine recording amounts of the colored recording materials to be recorded in the first region based on the color signals such that a total amount of the recording amount of the glossy recording material to be recorded in the first region determined by the first determination unit and the recording amounts of the colored recording materials to be recorded in the first region does not exceed the predetermined amount, and a third determination unit configured to determine recording amounts of colored recording materials to be recorded in a second region of the image based on the color signals and the recording amounts of the colored recording materials determined by the second determination unit.

Further features of the present disclosure will become apparent from the following description of exemplary embodiments with reference to the attached drawings.

BRIEF DESCRIPTION OF THE DRAWINGS

FIG. 3 is a diagram illustrating a color separation lookup table representing the correspondence relationship between color signals and virtual ink amounts according to one or more aspects of the present disclosure.

FIGS. 9A and 9B are diagrams illustrating a color separation lookup table representing the correspondence relationship between color signals plus gloss signals and actual ink amounts according to one or more aspects of the present disclosure.

FIGS. 11A to 11C are diagrams schematically illustrating a process of combining actual ink amounts according to one or more aspects of the present disclosure.

DESCRIPTION OF THE EMBODIMENTS

Figure 1:
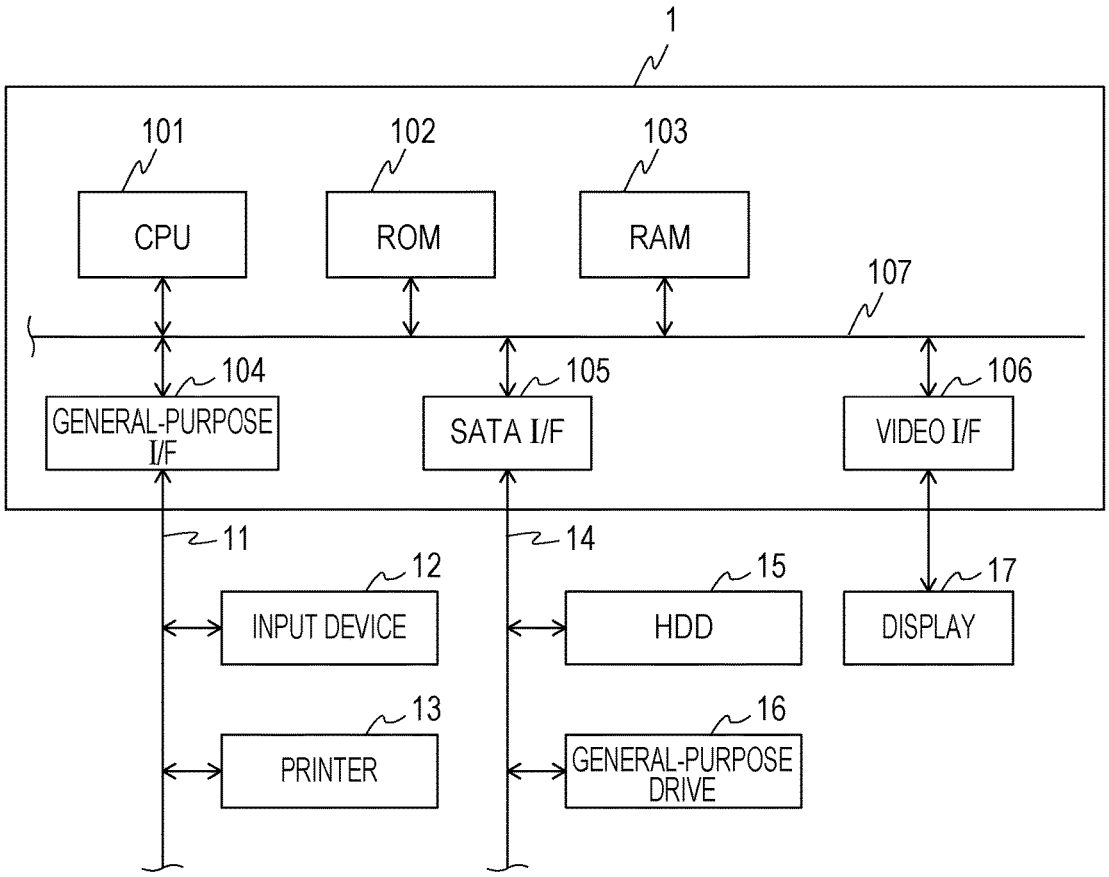
FIG. 1 is a block diagram illustrating a hardware configuration of an image processing apparatus according to one or more aspects of the present disclosure.

Hereinafter, embodiments of one or more aspects of the present disclosure will be described with reference to the accompanying drawings. Note that the embodiments described below do not limit the present disclosure, and it is not necessarily the case that all combinations of features described in the embodiments below are required for addressing various areas of the present disclosure. Note that the same configurations are denoted by the same reference numerals.

First Embodiment

Figure 13A:
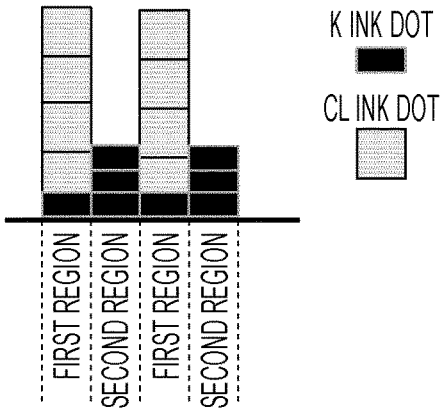
FIGS. 13A to 13E are sectional views schematically illustrating images formed in accordance with dot placements according to one or more aspects of the present disclosure.
Figure 13B:
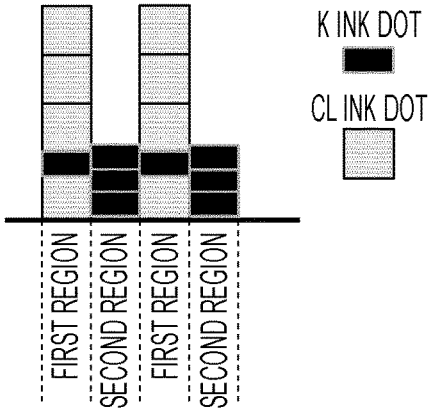
Figure 13C:
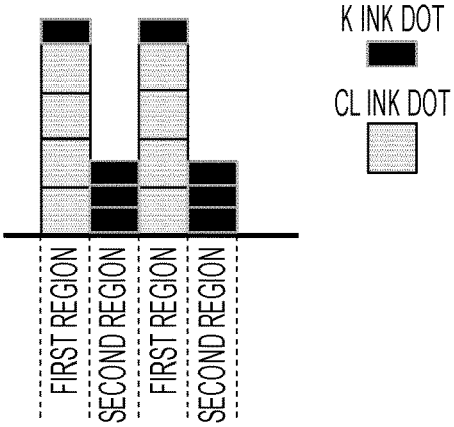

In one or more aspects of the present disclosure, gloss which is correlated with roughness of a surface of a printout is controlled by recording glossy ink only in a specific region in an image recorded by a color ink (a colored ink). Although a case where roughness is formed by clear ink (glossy ink) on a surface of a color ink as illustrated in FIG. 13A in this embodiment, order of discharge of clear ink is not limited to this case. Any order is employed as long as roughness on a surface of a printout may be controlled using differences among amounts of ink in regions, and a portion of the clear ink or entire clear ink may become a base of the color ink as illustrated in FIGS. 13B and 13C.

The term "glossy ink" in one or more aspects of the present disclosure indicates ink which controls a characteristic of light (gloss) which is approximately reflected in a specular reflection direction in which reflection on a printed matter due to illumination becomes maximum. Examples of the glossy ink include colorless clear ink and metallic ink capable of representing gloss of metal. Note that a colorless ink may be slightly colored or become cloudy as long as the colorless ink does not affect density represented by a recording medium. In one or more aspects of the present disclosure, colorless transparent clear ink is used as the glossy ink.

Hereinafter, ink is represented by names of colors, such as cyan, magenta, yellow, black, clear, and metallic. Furthermore, colors and data of the ink are represented by capital letters C, M, Y, K, CL, and ME. Specifically, C indicates a color of cyan or data of cyan, M indicates a color of magenta or data of magenta, Y indicates a color of yellow or data of yellow, and K indicates a color of black or data of black. The same is true on CL and ME. Note that the number of inks is not limited to the foregoing example as long as at least one type of color ink and a clear ink are used. In one or more aspects of the present disclosure, a term "pixel" indicates a minimum unit of gradation expression, and is a minimum unit of image processing to be performed on input data of a plurality of bits.

FIG. 1 is a hardware configuration of an image processing apparatus 1 according to one or more aspects of the present disclosure. The image processing apparatus 1 is a computer, for example, and includes a central processing unit (CPU) 101, a read only memory (ROM) 102, and a random access memory (RAM) 103. The CPU 101, which may include one or more processors and one or more memories, executes various programs including an operating system (OS) stored in the ROM 102 or a hard disk drive (HDD) 15 using the RAM 103 as a work memory. Furthermore, the CPU 101 controls the components through a system bus 107. Processes of flowcharts described below are executed when program codes stored in the ROM 102 or the HDD 15 are developed in the RAM 103 and executed by the CPU 101. An input device 12 including a mouse and a keyboard and a printer 13 are connected to a general-purpose interface (I/F) 104 through a serial bus 11. The HDD 15 and a general-purpose drive 16 which performs reading and writing on various recording media are connected to a serial ATA (SATA) I/F 105 through a serial bus 14. The CPU 101 uses the HDD 15 and various recording media mounted on the general-purpose drive 16 as storage of various data. A display 17 is connected to a video I/F 106. The CPU 101 displays user interfaces (UIs) provided by programs on the display 17 and receives an input, such as a user instruction, through the input device 12.

Figure 2:
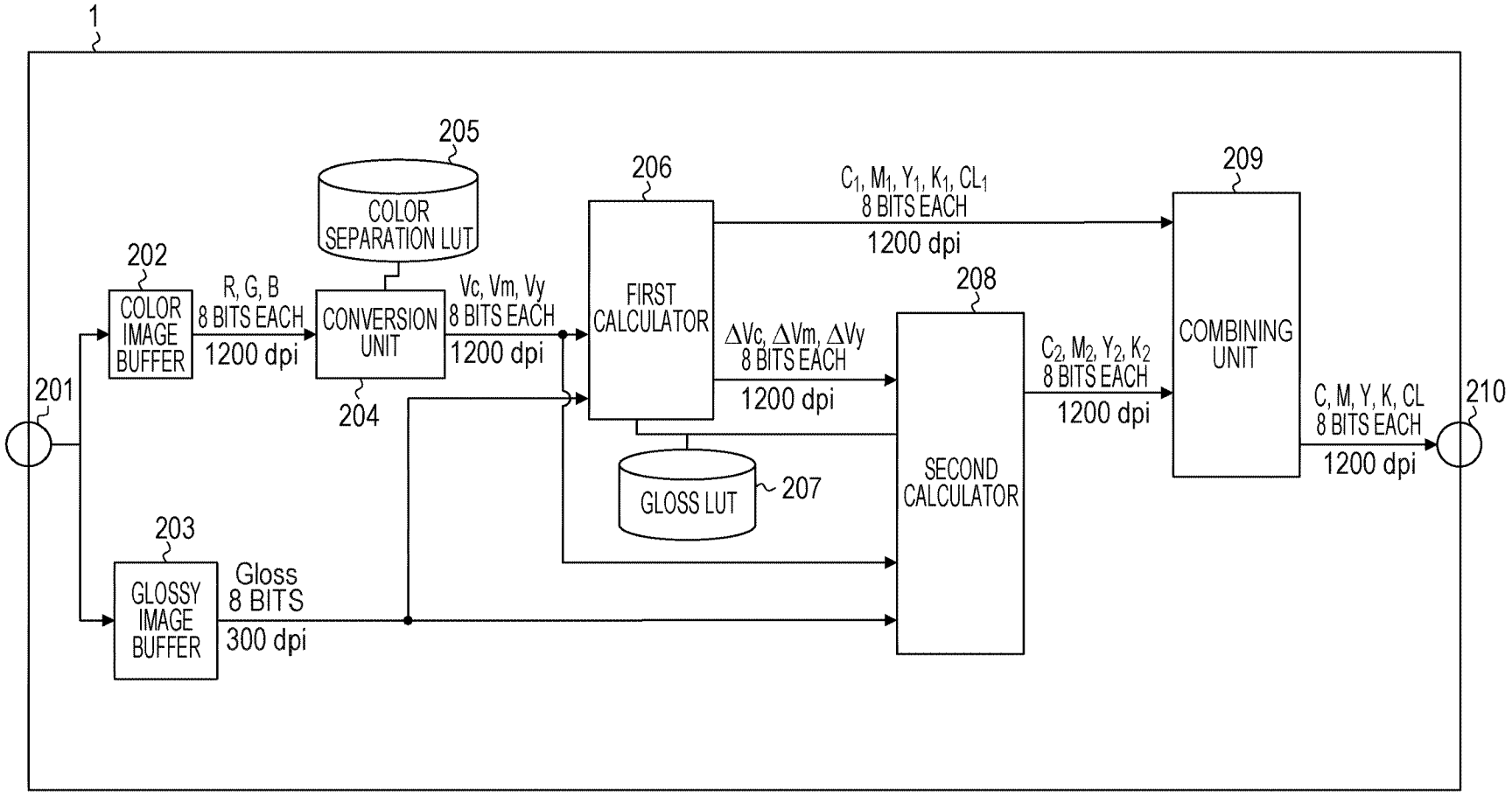
FIG. 2 is a block diagram illustrating a logical configuration of the image processing apparatus according to one or more aspects of the present disclosure.

Next, a logical configuration of the image processing apparatus 1 of one or more aspects of the present disclosure will be described. FIG. 2 is a block diagram illustrating a logical configuration of the image processing apparatus 1 according to one or more aspects of the present disclosure. The image processing apparatus 1 may be embodied by a printer driver installed in a general personal computer, for example. In this case, portions of the image processing apparatus 1 described below are realized when the computer executes predetermined programs.

The image processing apparatus 1 includes a data input terminal 201, a color image buffer 202, a glossy image buffer 203, a conversion unit 204, a color separation look up table (LUT) 205, a first calculator 206, a gloss LUT 207, a second calculator 208, a combining unit 209, and a data output terminal 210. The data input terminal 201 obtains color image data indicating a color signal and glossy image data indicating a gloss signal which are to be stored in the color image buffer 202 and the glossy image buffer 203, respectively. The color image data corresponds to a color image of three planes having resolution of 1200 dpi and having data (color signals) of R of 8 bits, G of 8 bits, and B of 8 bits for each pixel. The glossy image data corresponds to a grayscale image of one plane having resolution of 300 dpi and data (a gloss signal) of 8 bits for each pixel. Note that the gloss signal is represented as "Gloss" hereinafter. The conversion unit 204 converts input color signals into virtual ink amounts Vc, Vm, and Vy with reference to the color separation LUT 205 which stores the correspondence relationship between a color signal and the virtual ink amounts of the colored inks. The first calculator 206 calculates actual ink amounts $C_1$, $M_1$, $Y_1$, $K_1$, and $CL_1$ to be used for recording in a region where a clear ink is used for recording (a first region) using the gloss LUT 207 which stores the correspondence relationship between the gloss signal and a dot placement of the clear ink. The second calculator 208 calculates actual ink amounts $C_2$, $M_2$, $Y_2$, and $K_2$, to be recorded in a region where a clear ink is not applied (a second region) with reference to the gloss LUT 207. The combining unit 209 combines the actual ink amounts $C_1$, $M_1$, $Y_1$, $K_1$, and $CL_1$ in the first region and the actual ink amounts $C_2$, $M_2$, $Y_2$, and $K_2$ in the second region so as to generate actual ink amount data indicating actual ink amounts C, M, Y, K, and CL of the inks corresponding to the input data. The data output terminal 210 outputs the actual ink amount data.

The units described throughout the present disclosure are exemplary and/or preferable modules for implementing processes described in the present disclosure. The modules can be hardware units (such as one or more processors, one or more memories, circuitry, a field programmable gate array, a digital signal processor, and application specific integrated circuit or the like) and/or software modules (such as a computer readable program or the like). The modules for implementing the various steps are not described exhaustively above. However, where there is a step of performing a certain process, there may be a corresponding functional module or unit (implemented by hardware and/or software) for implementing the same process. Technical solutions by all combinations of steps described and units corresponding to these steps are included in the present disclosure.

Figure 5:
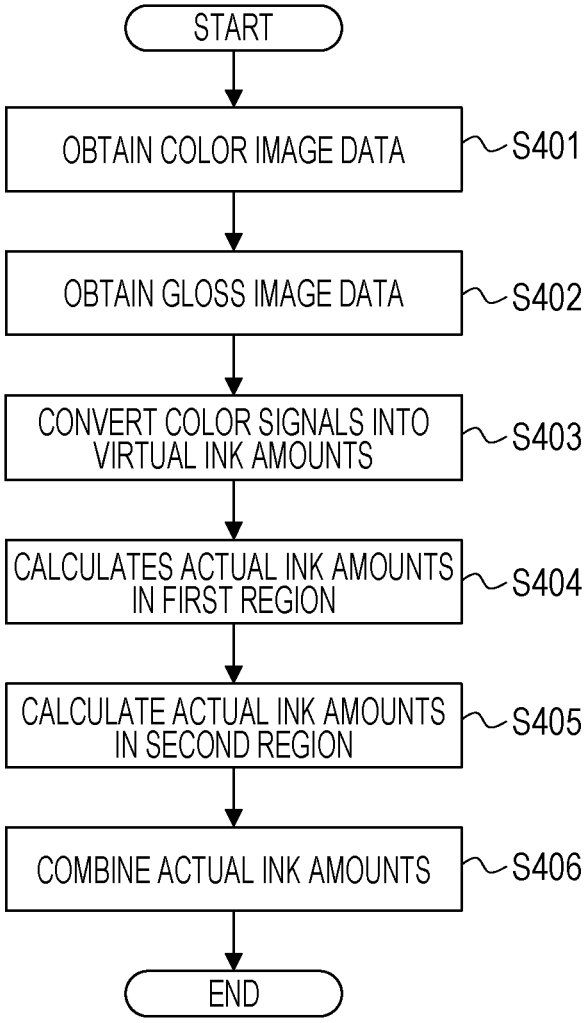
FIG. 5 is a flowchart of a process executed by the image processing apparatus according to one or more aspects of the present disclosure.

Next, a flow of a process performed by the image processing apparatus 1 of one or more aspects of the present disclosure having the logical configuration described above will be described with reference to a flowchart of FIG. 5. Hereinafter, various steps (processes) are represented by reference numerals having "S" added before the reference numerals.

In step S401, the data input terminal 201 obtains color image data to be stored in the color image buffer 202. In step S402, the data input terminal 201 obtains glossy image data to be stored in the glossy image buffer 203.

In step S403, the conversion unit 204 converts color signals (R, G, and B values) indicated by the color image data obtained from the color image buffer 202 into virtual ink amounts (virtual recording amounts) Vc, Vm, and Vy. In one or more aspects of the present disclosure, the virtual ink is not an actual ink but a virtual colored ink having an absorption wavelength band suitable for reproducing a color represented by a color signal. In one or more aspects of the present disclosure, three types of virtual inks, that is, a virtual ink y having an absorption wavelength band in a range from 480 nm to 730 nm, a virtual ink m having an absorption wavelength band in a range from 380 nm to 480 nm and in a range from 580 nm to 730 nm, and a virtual ink c having an absorption wavelength band in a range from 380 nm to 580 nm, are used. The virtual inks will be described in detail hereinafter. On the other hand, the actual ink amount indicates a recording amount of ink actually used for formation of an image. In this step, the color signals R, G, and B of each pixel are converted into the virtual ink amounts Vc, Vm, and Vy with reference to the color separation LUT 205 indicating the correspondence relationship between the color signals R, G, and B and virtual ink recording amounts. The color separation LUT 205 is illustrated in FIG. 3.

In step S404, the first calculator 206 calculates the actual ink amounts $C_1$, $M_1$, $Y_1$, $K_1$, and $CL_1$ to be recorded in the first region based on the virtual ink amounts Vc, Vm, and Vy and a gloss signal Gloss. Furthermore, the first calculator 206 calculates color differences ΔVc, ΔVm, and ΔVy generated since recording of the clear ink is preferentially performed. The process in step S404 will be described in detail hereinafter. In step S405, the second calculator 208 calculates the actual ink amounts $C_2$, $M_2$, $Y_2$, and $K_2$, to be recorded in the second region based on the virtual ink amounts Vc, Vm, and Vy, the gloss signal Gloss, and the color differences ΔVc, ΔVm, and ΔVy calculated in step S404. The process in step S405 will be described in detail hereinafter.

In step S406, the combining unit 209 combines the actual ink amounts $C_1$, $M_1$, $Y_1$, $K_1$, and $CL_1$ in the first region with the actual ink amounts $C_2$, $M_2$, $Y_2$, and $K_2$ in the second region (an addition process) so as to generate actual ink amount data indicating actual ink amounts of the inks. The actual ink amounts indicated by the actual ink amount data obtained after the combining are denoted by C, M, Y, K, and CL which are determined in accordance with Expressions 1A to 1E below with reference to two actual ink amount data for each pixel.

$$C=C_1+C_2 \quad \text{Expression 1A}$$

$$M=M_1+M_2 \quad \text{Expression 1B}$$

$$Y=Y_1+Y_2 \quad \text{Expression 1C}$$

$$K=K_1+K_2 \quad \text{Expression 1D}$$

$$CL=CL_1 \quad \text{Expression 1E}$$

FIG. 11A is a diagram illustrating the actual ink amounts $C_1$, $M_1$, $Y_1$, $K_1$, and $CL_1$ in the first region, and FIG. 11B is a diagram illustrating actual ink amounts $C_2$, $M_2$, $Y_2$, and $K_2$ in the second region. Furthermore, FIG. 11C is a diagram illustrating actual ink amounts C, M, Y, K, and CL obtained after the combining.

The series of processes for determining actual ink amounts relative to the color signals and the gloss signal is thus completed. Next, the processes in step S404 and step S405 will be described in detail.

Figure 6:
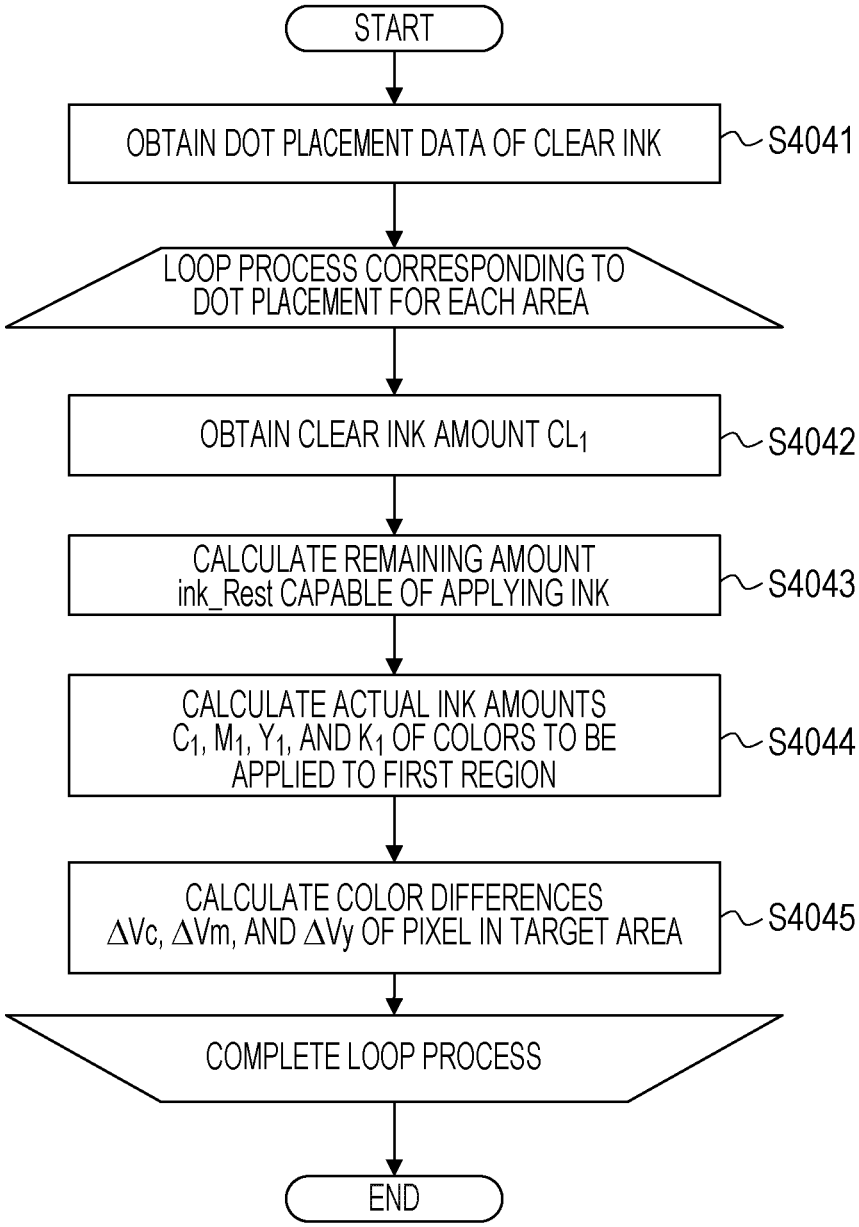
FIG. 6 is a flowchart of a process of calculating actual ink amounts in a first region according to one or more aspects of the present disclosure.

First, the process of calculating the actual ink amounts in the first region (S404) will be described with reference to a flowchart of FIG. 6. In step S404, the actual ink amounts $C_1$, $M_1$, $Y_1$, $K_1$, and $CL_1$ in the first region and color difference information Δc, Δm, and Δy are calculated based on the color signals R, G, and B and the gloss signal Gloss.

Figure 4A:
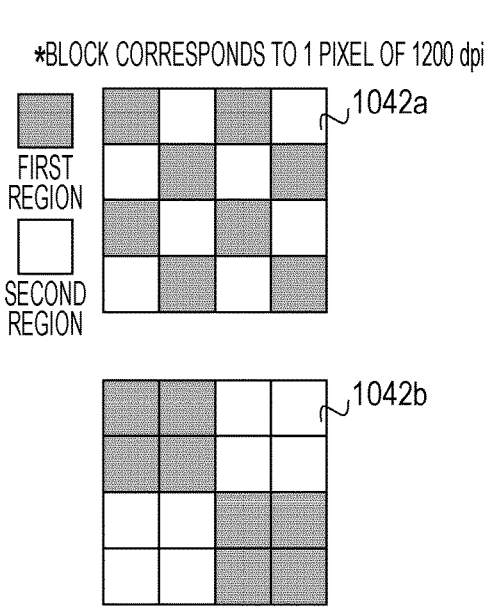
FIGS. 4A to 4C are diagrams illustrating a lookup table representing the correspondence relationship between a gloss signal and a dot placement of clear ink according to one or more aspects of the present disclosure.
Figure 4B:
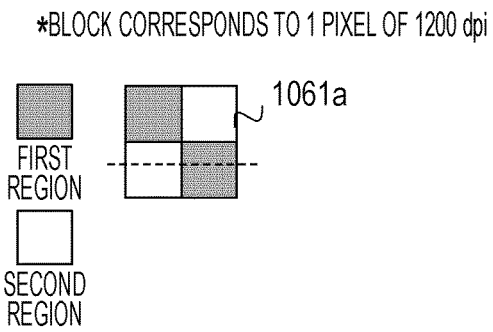
Figure 4C:
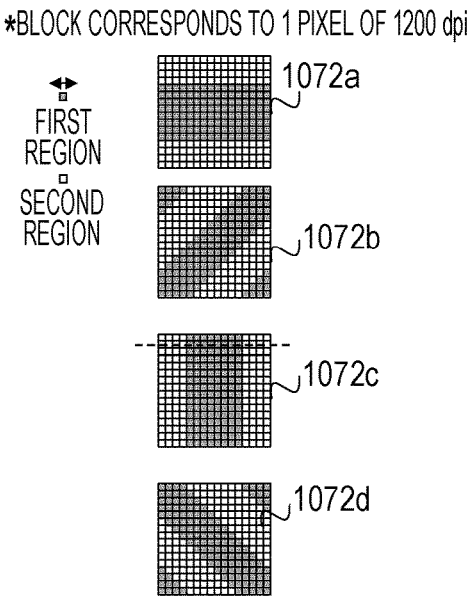

In step S4041, dot placement data indicating a dot placement of the clear ink is obtained with reference to the gloss LUT 207 which stores the correspondence relationship between the gloss signal Gloss and the dot placement of clear ink on a recording medium. The gloss LUT 207 is illustrated in FIG. 4A. The gloss LUT 207 stores values of gloss signals, recording amounts of the clear ink corresponding to the values of the gloss signals, and dot placement. The dot placement of the clear ink corresponding to a gloss signal is generated in accordance with a method described below, for example. First, a chart is printed by fixing a dot placement in advance and changing an amount of the clear ink a plurality of times so that gloss is measured. Then a dot placement corresponding to a gloss signal is determined based on the relationship between the measured amount of clear ink and the gloss. An example of dot placement data of the clear ink is denoted by a reference numeral 1042*a* of FIG. 4A. The dot placement data is binary data indicating a pixel in which the clear ink is to be used for recording (a first region) or a pixel in which the clear ink is not to be used for recording (a second region) in each of pixels in a matrix of 4 rows by 4 columns which have been subjected to a process of conversion from resolution of glossy image data into that of color image data. The region including the pixels in the matrix of 4 rows by 4 columns includes both of the first and second regions. The dot placements corresponding to the gloss values illustrated in FIGS. 4A to 4C are merely examples and the present disclosure is not limited to the examples. Any dot placement may be employed as long as the dot placement is suitable for gloss control, and dot placement 1042*b* illustrated in FIG. 4A may be employed.

In a subsequent process (S4042 to S4045), pixels in a matrix of 4 rows by 4 columns of color image data corresponding to one pixel of the glossy image data are determined as one area, and thereafter, various areas in the color image data are successively selected. When an area is selected, it is determined whether each of the pixels included in the selected area is a first region or a second region based on the dot placement data obtained in step S4041. When a pixel is determined as the first region in the determination process described above, an actual ink amount for recording in the first region is calculated. The area selection and the process are repeatedly performed until all the areas are processed. After all the areas are processed, the process proceeds to step S405.

Next, the process of calculating actual ink amounts in the first region performed when a pixel in a selected area is determined as the first region will be described.

In step S4042, an actual ink amount $CL_1$ of the clear ink corresponding to a value of the gloss signal Gloss is determined with reference to the gloss LUT 207 illustrated in FIG. 4A. In step S4043, a remaining amount ink_Rest of the actual ink amount which is recordable in the pixel of a processing target is calculated by a subtraction of Expression 2 using a maximum recording amount ink_Max which is stored in advance and the value $CL_1$ determined in step S4042. A recording amount, as used herein, may refer to a predetermined amount, an acceptable amount, a recording amount, or the like. Note that the maximum recording amount indicates a maximum total amount (an upper limit value) of ink which is not overflowed and which is penetrated and fixed when the ink is applied to the pixel. To obtain the maximum recording amount ink_Max, a chart including a patch generated by changing an amount of ink a plurality of times is printed and an amount of ink which is not overflowed and which is penetrated and fixed on the recording medium is obtained with reference to a result of the printing. The ink amount is stored as the maximum recording amount ink_Max. Note that a plurality of maximum recording amounts ink_Max are preferably stored for different recording media to be printed or different printing methods. Although a maximum recording amount which is stored in the apparatus is obtained and used in one or more aspects of the present disclosure, a maximum recording amount stored in an external recording apparatus, such as the HDD 15, may be obtained and used.

$$ink_Rest = ink_Max - CL_1 \quad \text{Expression 2}$$

Note that a paper white portion is preferably reduced as much as possible in a range from a middle density portion to a high density portion so that preferred graininess of a color image indicating color of an image in a printed matter is attained. Therefore, a maximum value of the actual ink amount $CL_1$ of the clear ink stored in the gloss LUT 207 illustrated in FIG. 4A is preferably smaller than the maximum recording amount ink_Max.

In step S4044, actual ink amounts $C_1$, $M_1$, $Y_1$, and $K_1$ of the color inks to be recorded in the target pixel are calculated using the virtual ink amounts Vc, Vm, and Vy of the pixel of the processing target in the color image data and the remaining amount ink_Rest calculated in step S4043.

In one or more aspects of the present disclosure, the correspondence relationships between the actual ink amounts C, M, Y, and K and the virtual ink amount Vc, Vm, and Vy are stored in advance, and the actual ink amounts are determined with reference to the relationships.

Hereinafter, firstly, definitions of virtual inks and amounts of virtual inks are described, and secondly, a method for obtaining the relationships between actual ink amounts and virtual ink amounts is described. Lastly, a method for determining the actual ink amount using the virtual ink amount based on the relationships described above is described.

Figure 15A:
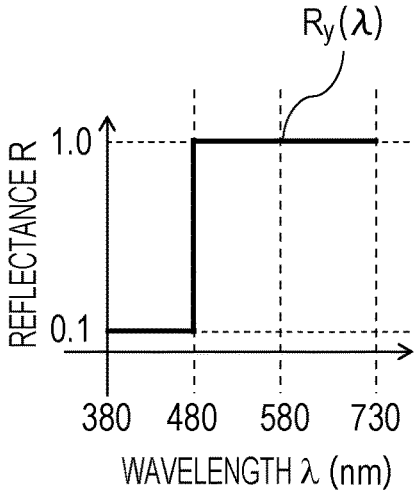
FIGS. 15A to 15C are diagrams schematically illustrating a virtual spectral reflectance according to one or more aspects of the present disclosure.
Figure 15B:
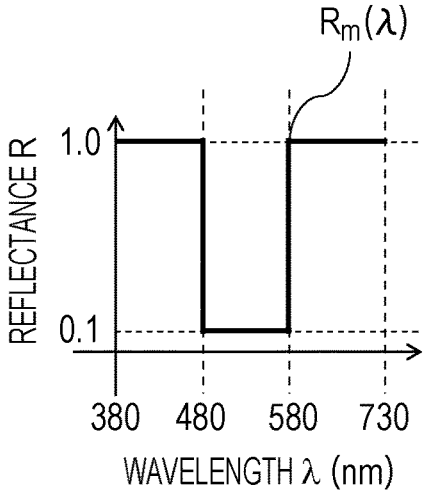
Figure 15C:
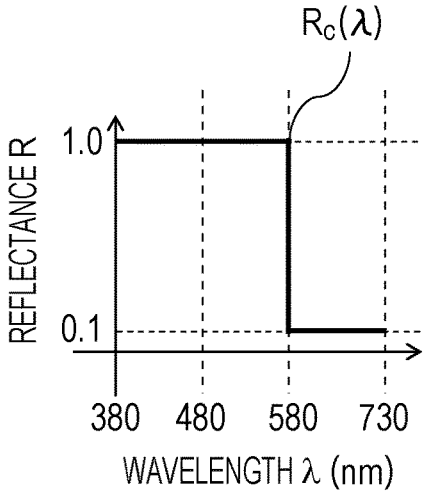

First, terms to be used hereinafter will be defined. A wavelength is denoted by "λ", and a spectral reflectance is denoted by "R(λ)". A value D(λ) converted in accordance with the following equation is referred to as a "spectral density": $D(\lambda) = -\log 10R(\lambda)$. A value obtained by dividing the spectral density D(λ) by a wavelength block in an arbitrary interval and averaging spectral densities in the block is referred to as a "block density". Furthermore, block densities Dy, Dm, and Dc for wavelength bands corresponding to yellow, magenta, and cyan (380 nm to 480 nm, 480 nm to 580 nm, and 580 nm to 700 nm, for example) are referred to as "virtual block densities". Moreover, spectral reflectances Ry(λ), Rm(λ), and Rc(λ) corresponding to the virtual block densities Dy, Dm, and Dc, respectively, are referred to as "virtual spectral reflectances". FIGS. 15A to 15C are diagrams illustrating the virtual spectral reflectances Ry(λ), Rm(λ), and Rc(λ). The term "virtual inks" in one or more aspects of the present disclosure indicates virtual inks c, m, and y having the virtual spectral reflectances Ry(λ), Rm(λ), and Rc(λ).

Next, a method for obtaining the correspondence relationship between actual inks and virtual inks will be described. First, spectral reflectances are measured when the actual inks of the various colors are recorded on a sheet surface with an arbitrary actual ink amount α, and block reflectances are calculated and converted into block densities Dy, Dm, and Dc. When an actual ink amount of a C ink is α, block densities are denoted by "Cα_Dc", "Cα_Dm", and "Cα_Dy" and virtual ink amounts are denoted by "Vc", "Vm", and "Vy". It is further assumed that, when a block density Di is 2.0, a virtual ink amount Vi is 100, and coefficients C_Vc, C_Vm, and C_Vy of the virtual ink amounts corresponding to the actual ink amount of the C ink are calculated in accordance with Expression 3A to 3C below.

$$C_Vc = (C_Dc/2.0)/\alpha \quad \text{Expression 3A}$$

$$C_Vm = (C_Dm/2.0)/\alpha \quad \text{Expressin 3B}$$

$$C_Vy = (C_Dy/2.0)/\alpha \quad \text{Expression 3C}$$

Coefficients of the virtual ink amounts of inks M, Y, K are similarly calculated. The coefficients of the virtual ink amounts corresponding to the actual ink amounts are stored as the relationships between the actual ink amounts and the virtual ink amounts.

Next, a method for calculating the actual ink amounts $C_1$, $M_1$, $Y_1$, and $K_1$ of the color inks applied to the first region using the virtual ink amounts Vc, Vm, and Vy of the pixel of the processing target in the color image data and the remaining amount ink_Rest in accordance with the coefficients of the virtual ink amounts relative to the actual ink amounts will be described.

In one or more aspects of the present disclosure, priority order of colored inks are determined, and the actual ink amounts $C_1$, $M_1$, $Y_1$, and $K_1$ of the color inks to be applied to the first region are determined such that the actual ink amounts are equal to or smaller than the remaining amount ink_Rest based on the determined priority order.

First, a method for determining the priority order of colored inks will be described. Among the colored inks, an achromatic ink in which a total value of the coefficients of the virtual ink amounts relative to the actual ink amounts is large and high density is realized with a small amount of ink (the K ink in one or more aspects of the present disclosure) is most preferentially selected. After the achromatic ink is selected, a colored ink corresponding to a largest one of the virtual ink amounts Vc, Vm, and Vy which remain after the selection is selected. For example, when the virtual ink amount Vc remains largest, the actual ink amount of the C ink is preferentially determined.

Next, a method for determining the actual ink amounts using the virtual ink amounts based on the colored ink selected based on the priority order will be described.

The selected ink is denoted by "i" (i=C, M, Y, or K). First, coefficients i_Vc, i_Vm, and i_Vy of the virtual ink amounts relative to the actual ink amounts of the ink i are obtained. Next, assuming that an actual ink amount of the selected ink is denoted by "ix" and a total value of actual ink amounts which have been obtained is denoted by "$i_{total}$", the actual ink amount ix which is largest while conditional expressions 4A to 4D below are satisfied based on the coefficients is obtained. The actual ink amount ix is gradually increased from 0.

$$ix \times i_Vc \leq Vc \quad \text{Expression 4A}$$

$$ix \times i_Vm \leq Vm \quad \text{Expression 4B}$$

$$ix \times i_Vy \leq Vy \quad \text{Expression 4C}$$

$$ix \leq ink_Rest - i_{total} \quad \text{Expression 4D}$$

The calculation of the actual ink amount ix is repeatedly performed until all the inks are processed or equality of Expression 4D is satisfied.

By the process described above, the actual ink amounts $C_1$, $M_1$, $Y_1$, and $K_1$ of the color inks to be applied to the first region are calculated using the virtual ink amounts Vc, Vm, and Vy and the remaining amount ink_Rest.

In step S4045, color differences ΔVc, ΔVm, and ΔVy between colors reproduced by the actual ink amounts $C_1$, $M_1$, $Y_1$, and $K_1$ which are determined in step S4044 and colors reproduced by the virtual ink amounts c, m, and y of the target pixel are calculated. First, the actual ink amounts determined in step S4044 are converted into virtual ink amounts Vc', Vm', and Vy' based on the correspondence relationships between the actual inks used in step S4044 and the virtual inks c, m, and y. Differences between the converted $Vc_j'$, $Vm_j'$, and $Vy_j'$ (j is positional information of the target pixel) and the virtual ink amounts $Vc_j$, $Vm_j$, and $Vy_j$ are calculated for each pixel in accordance with Expressions 5A to 5C below.

$$\Delta Vc_j = Vc_j - Vc_j' \quad \text{Expression 5A}$$

$$\Delta Vm_j = Vm_j - Vm_j' \quad \text{Expression 5B}$$

$$\Delta Vy_j = Vy_j - Vy_j' \quad \text{Expression 5C}$$

Total values are calculated for individual areas using the calculated color difference information $\Delta Vc_j$, $\Delta Vm_j$, and $\Delta Vy_j$ of the individual pixels. Assuming that the calculated total values are denoted by "ΔVct", "ΔVmt", and "ΔVyt" and the number of pixels in a second region in the area is denoted by "n", the color differences generated in the first region are calculated as the color difference information ΔVc, ΔVm, and ΔVy which are uniformly distributed for individual pixels in the second region.

$$\Delta Vc = \Delta Vct/n \quad \text{Expression 6A}$$

$$\Delta Vm = \Delta Vmt/n \quad \text{Expression 6B}$$

$$\Delta Vy = \Delta Vyt/n \quad \text{Expression 6C}$$

The calculated color difference information ΔVc, ΔVm, and ΔVy are supplied to step S405.

By performing the processing control described above, the actual ink amounts in the first region may be calculated by performing the processing control described above while application of the clear ink corresponding to a gloss signal is preferentially performed. In a calculation of actual ink amounts in the second region described below, ink amounts are determined such that the color differences ΔVc, ΔVm, and ΔVy generated since the application of the clear ink is preferentially performed in the first region are corrected.

Figure 7:
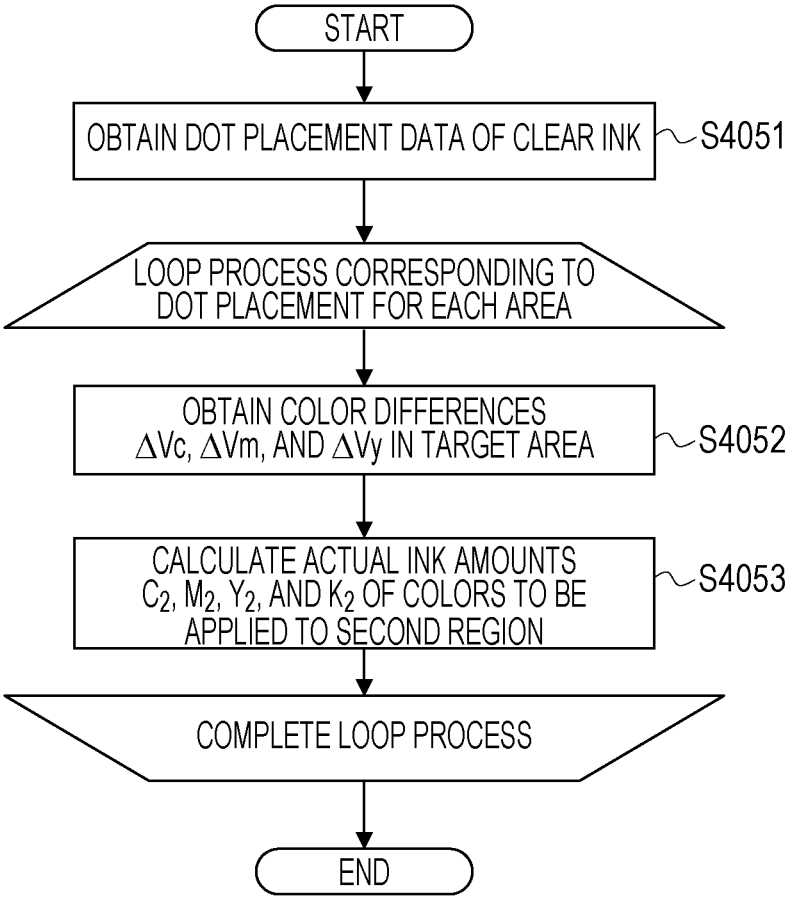
FIG. 7 is a flowchart of a process of calculating actual ink amounts in a second region according to one or more aspects of the present disclosure.

The process of calculating the actual ink amounts in the second region (S405) will be described with reference to a flowchart of FIG. 7. In step S405, the actual ink amounts $C_2$, $M_2$, $Y_2$, and $K_2$, to be applied to the second region are calculated based on the virtual ink amounts Vc, Vm, and Vy determined based on the color signals R, G, and B and the color difference information ΔVc, ΔVm, and ΔVy calculated in step S404.

In step S4051, as with step S4041, dot placement data representing a dot placement of the clear ink is obtained with reference to the gloss LUT 207 which stores the correspondence relationship between the gloss signal Gloss and the dot placement of the clear ink on a recording medium.

In a subsequent process (step S4052 and step S4053), as with step S4041, the determination process is performed and calculation of actual ink amounts is performed on pixels determined as the second region in the determination process described above. As with step S404, after all the areas are processed, the process proceeds to step S406.

In step S4052, the color difference information ΔVc, ΔVm, and ΔVy of the pixel of the processing target calculated in step S404 are obtained. In step S4053, the virtual ink amounts Vc, Vm, and Vy of the pixel of the processing target in the color image data and the color difference information ΔVc, ΔVm, and ΔVy obtained in step S4052 are added to each other. Actual ink amounts are calculated based on the added virtual ink amounts so that the calculated actual ink amounts correspond to actual ink amounts $C_2$, $M_2$, $Y_2$, and $K_2$ of the color inks to be applied to the second region. A method for calculating actual ink amounts from virtual ink amounts is the same as that employed in step S404, and therefore, a description thereof is omitted.

By performing the processing control described above, the actual ink amounts $C_2$, $M_2$, $Y_2$, and $K_2$ of the color inks in the second region may be calculated taking color differences generated in the first region into consideration while application of the clear ink is preferentially performed.

By performing the processing control described above, an amount of clear ink is preferentially determined with a strong emphasis on control of the gloss in the first region. Furthermore, in the second region, amounts of the color inks are determined such that color differences generated since an amount of the clear ink is preferentially determined in the first region are compensated for. Accordingly, enlargement of a control range of the gloss and reduction of a color difference for each region are realized, and both of reproduction of color and reproduction of gloss may be attained on the recording medium.

Note that, although the glossy image data has a gloss signal indicating gloss for each pixel in one or more aspects of the present disclosure, the glossy image data is not limited to the example described above. Any gloss signal may be employed as long as a gloss signal has a characteristic of light (gloss) which reflects illumination in an approximately specular reflection direction in which the reflection from the illumination becomes maximum and a characteristic in which the gloss signal is controllable by forming a structure using the clear ink on a printout. For example, the gloss signal may have gloss image clarity or reflection light intensity (gloss intensity) in the approximately specular reflection direction. To control gloss intensity, metallic ink is suitably used. FIG. 4B is a diagram illustrating the gloss LUT 207 representing the correspondence relationship between the gloss intensity and a metallic ink amount. When a thickness of a high reflection layer formed by a metallic ink (ME) becomes large, gloss intensity is increased, and therefore, an actual ink amount is stored in the gloss LUT 207 such that the high reflection layer becomes thick in accordance with input gloss intensity. As a dot placement, a unit of one pixel of 600 dpi (pixels of 1200 dpi in a matrix of 2 rows by 2 columns) is stored as one area (a dot placement 1061*a*).

Figure 13D:
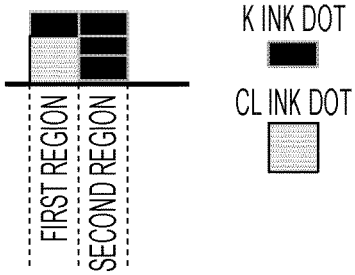
Figure 13E:
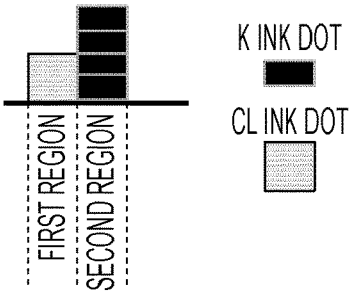

Alternatively, the gloss intensity may be controlled by controlling order of discharge of dots (a vertical placement). An example of the control of gloss intensity in order of discharge of dots (a vertical placement) is described with reference to FIGS. 13D and 13E. FIG. 13D is a cross sectional view schematically illustrating a dot placement 1061*a* in a dotted line portion. As illustrated in FIG. 13D, metallic ink is applied below color ink or the high reflection layer and a recording pixel of the color ink are disposed in parallel in FIG. 13E.

Alternatively, gloss may be input in a reflection direction of specular reflected light. For example, an inclination of a rough layer in a line screen shape (a line screen angle) which is formed on a surface of the recording medium by a colorless clear ink is controlled in accordance with the reflection direction of the input specular reflected light. FIG. 4C is a diagram illustrating the gloss LUT 207 representing the correspondence relationship between the reflection direction of the input specular reflected light and the dot placement of the clear ink. Here, a pattern in which one pixel of 75 dpi (pixels in 1200 dpi in a matrix of 16 rows by 16 columns) corresponds to one area as the dot placement is stored. For example, as illustrated in FIG. 4C, dot placements (1072*a* to 1072*d*) having different inclinations of the rough layer in the line screen shape are stored.

Figure 14A:
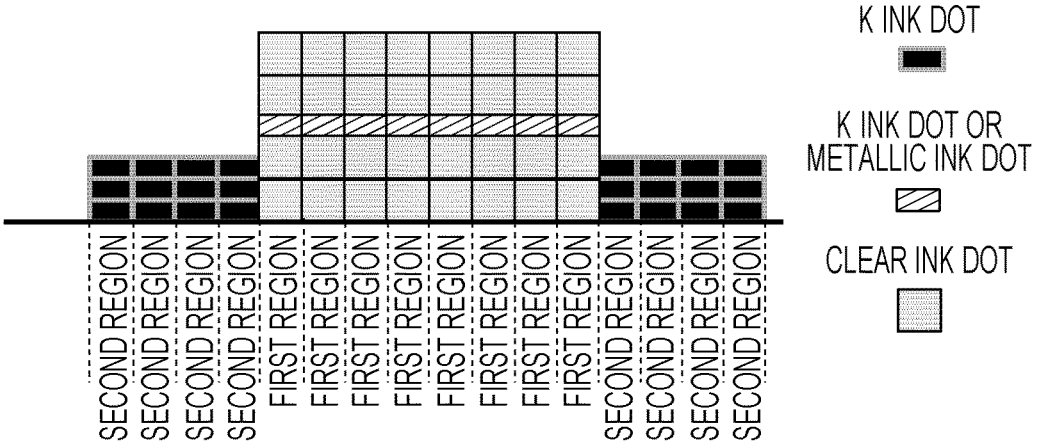
FIGS. 14A to 14C are sectional views schematically illustrating images formed in accordance with dot placements according to one or more aspects of the present disclosure.
Figure 14B:
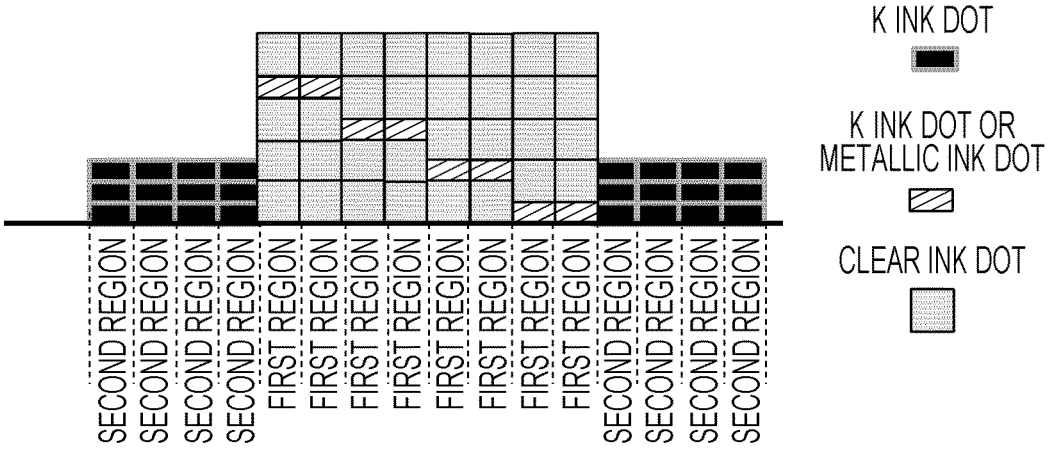
Figure 14C:
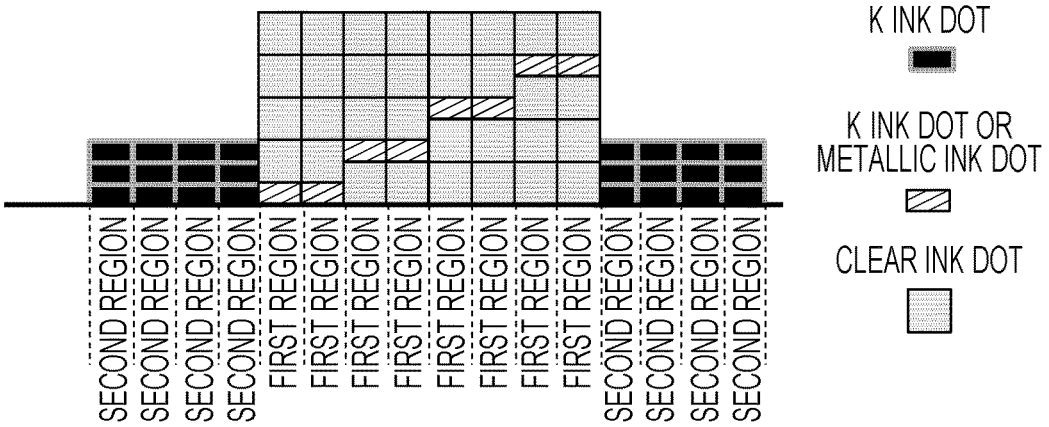

Alternatively, the reflection direction of the specular reflected light may be controlled by controlling order of discharge of dots (a vertical placement). In the case described above, a certain amount of clear ink CL of 200 and the dot placement 1072*c* are used irrespective of the reflection direction of the input specular reflected light. FIGS. 14A to 14C are cross sectional views schematically illustrating the dot placement 1072*c*. As illustrated in FIGS. 14A to 14C, an inclination of a reflection surface may be controlled by changing a position of a color ink (or metallic ink) in the clear ink so that expression corresponding to the reflection direction of the input specular reflected light is realized.

Although one type of gloss signal is input in one or more aspects of the present disclosure, the gloss signal is not limited to the example described above. If a structure of a combination of two gloss characteristics may be formed on a printout by use of the clear ink, data of a plurality of planes obtained by combining two or more gloss signals may be used as input.

Although the color differences generated in the first region are uniformly distributed to the pixels in the second region in one or more aspects of the present disclosure, the disclosure is not limited to the example described above. A ratio of the distribution of the color differences may be controlled in accordance with a distance from the first region. For example, the ratio of the distribution of the color differences may be reduced as the distance becomes larger. Furthermore, the color differences may be locally distributed so that a pattern in which a placement of distributed pixels is difficult to be visibly recognized may be realized.

Note that, although colored inks are used as colored recording materials which represent colors in one or more aspects of the present disclosure, colored toner or the like may be used as a recording material. Furthermore, although glossy inks are used as glossy recording materials which represent gloss in one or more aspects of the present disclosure, glossy toner may be used as a glossy material. Examples of the glossy toner include a clear toner and a metallic toner.

Although the color differences between the colors reproduced by the actual ink amounts of the inks applied to the first region and the colors reproduced by the virtual ink amounts c, m, and y of the target pixel are calculated, the color differences to be used may be obtained from a table. The table used in this case includes the color signals, the actual ink amounts of the inks applied to the first region, and the color differences which are associated with one another. This table is generated in advance by forming a patch on a recording medium based on the color signals and the actual ink amounts of the inks applied to the first region and performing colorimetry on the patch.

Although the actual ink amounts of the color inks applied to the second region are determined by uniformly distributing the color differences generated in the first region to the pixels in the second region in one or more aspects of the present disclosure, the disclosure is not limited to this. The following example may be embodied, for example. First, actual ink amounts of color inks to be applied to the first and second regions are determined by a general color separation process performed on color signals. Next, actual ink amounts of color inks which are to be overflowed from the first region are calculated based on a dot placement of glossy ink, ink acceptable amount of a recording medium, and actual ink amounts of inks applied to the first region. The calculated actual ink amounts of the color inks which are to be overflowed from the first region are distributed to actual ink amounts of color inks applied to the second region.

Second Embodiment

In the first embodiment, the method for obtaining the actual ink amounts using the virtual ink amounts Vc, Vm, and Vy obtained by converting the color signals is described. In a second embodiment, a case where an LUT in which color signals and actual ink amounts are associated with each other for each of first and second regions included in an image in advance so that the actual ink amounts are calculated within a shorter period of time will be described as an example.

Figure 8:
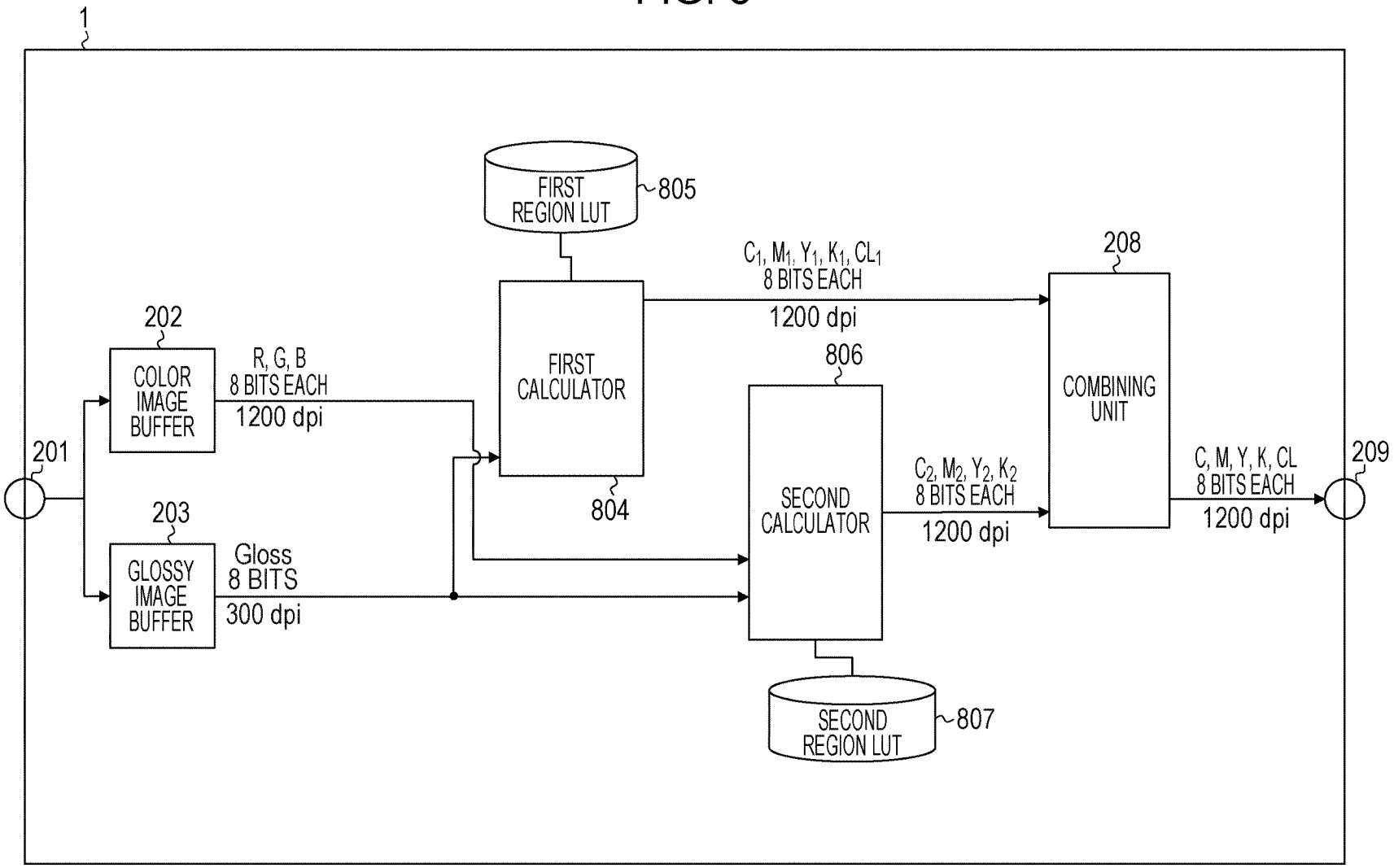
FIG. 8 is a block diagram illustrating a logical configuration of an image processing apparatus according to one or more aspects of the present disclosure.

FIG. 8 is a block diagram illustrating a logical configuration of an image processing apparatus 1 according to the second embodiment. Components 201, 202, 203, 208, and 209 included in the image processing apparatus 1 are the same as the components 201, 202, 203, 209, and 210 according to the first embodiment, respectively, and therefore, descriptions thereof are omitted. Components 804 to 807 which are different from the first embodiment are mainly described.

A first calculator 804 determines actual ink amounts $C_1$, $M_1$, $Y_1$, $K_1$, and $CL_1$ in a first region based on color signals R, G, and B and a gloss signal Gloss with reference to a first region LUT 805 which stores the relationship among the color signals, the gloss signals, and actual ink amounts. Specifically, as with the first embodiment, dot placement data of a clear ink is obtained based on the gloss signal Gloss with reference to the first region LUT 805 and it is determined whether a target pixel is included in the first region.

The actual ink amounts $C_1$, $M_1$, $Y_1$, $K_1$, and $CL_1$ in the first region are determined for the pixel determined as the first region based on the corresponding color signals R, G, and B and the gloss signal Gloss with reference to the first region LUT 805.

The first region LUT 805 is illustrated in FIG. 9A. A method for generating the first region LUT 805 will be described hereinafter. First, a chart including a plurality of standards under a condition in which a sum of an amount of a clear ink for expressing the gloss signal Gloss and an amount of a color ink which is a base of the dot placement is smaller than a maximum recording amount ink_Max is printed. Subsequently, a spectral reflectance R_in(λ) of the printed chart is measured. A color ink amount in which the measured spectral reflectance R_in(λ) and a target spectral reflectance R_target(λ) are closest to each other is searched for and stored in the first region LUT 805.

A second calculator 806 determines actual ink amounts $C_2$, $M_2$, $Y_2$, and $K_2$, in the second region based on the color signals R, G, and B and the gloss signal Gloss with reference to a second region LUT 807 which stores the correspondence relationships among the color signals, the gloss signals, and actual ink amounts in the second region. Specifically, as with the first embodiment, dot placement data of a clear ink is obtained based on the gloss signal Gloss with reference to the second region LUT 807 and it is determined whether a target pixel is included in the second region. The actual ink amounts $C_2$, $M_2$, $Y_2$, and $K_2$, in the second region are determined for the pixel determined as the second region based on the corresponding color signals R, G, and B and the gloss signal Gloss with reference to the second region LUT 807.

The second region LUT 807 is illustrated in FIG. 9B. A method for generating the second region LUT 807 will be described hereinafter.

First, a chart of the color ink amounts of the first region LUT 805 is printed with reference to the first region LUT 805 generated in advance so that a spectral reflectance R_in' (λ) is measured. Subsequently, a chart including a plurality of standards under a condition in which the color ink amounts are smaller than the maximum recording amount ink_Max is printed, and a spectral reflectance R_in" (λ) is measured. Finally, the spectral reflectance R_in" (λ) which is close to an additional value of the spectral reflectance R_in' (λ) and the spectral reflectance R_target(λ) is searched for, and color ink amounts which realize the spectral reflectance R_in' (λ) are stored in the second region LUT 807.

By this, an amount of a glossy ink and amounts of colored inks which realize both of reproduction of color and reproduction of gloss on a recording medium may be determined by performing the processing control described above.

Note that, although the example of LUT which stores actual ink amounts for each gloss signal Gloss is described in one or more aspects of the present disclosure, the disclosure is not limited to the example described above. For example, only actual ink amounts for an arbitrary gloss signal Gloss may be stored, and actual ink amounts based on other gloss signals Gloss may be calculated based on differences of clear ink amounts caused by differences of the gloss signals Gloss.

Third Embodiment

A method for realizing both of enlargement of a range in which gloss may be controlled by determining actual ink amounts and reduction of color differences between regions is described in the first and second embodiments. In a third embodiment, a method for preferentially determining an ink dot placement of a first region when the ink dot placement is determined in accordance with actual ink amounts and determining an ink dot placement of a second region based on a result of the determination will be described. Furthermore, to control order of overlap of dots, a multipass scanning method for generating an image by performing scanning a plurality of times on the same region on a recording medium (the number of times recording scan is performed is denoted by "p") is employed.

Figure 10:
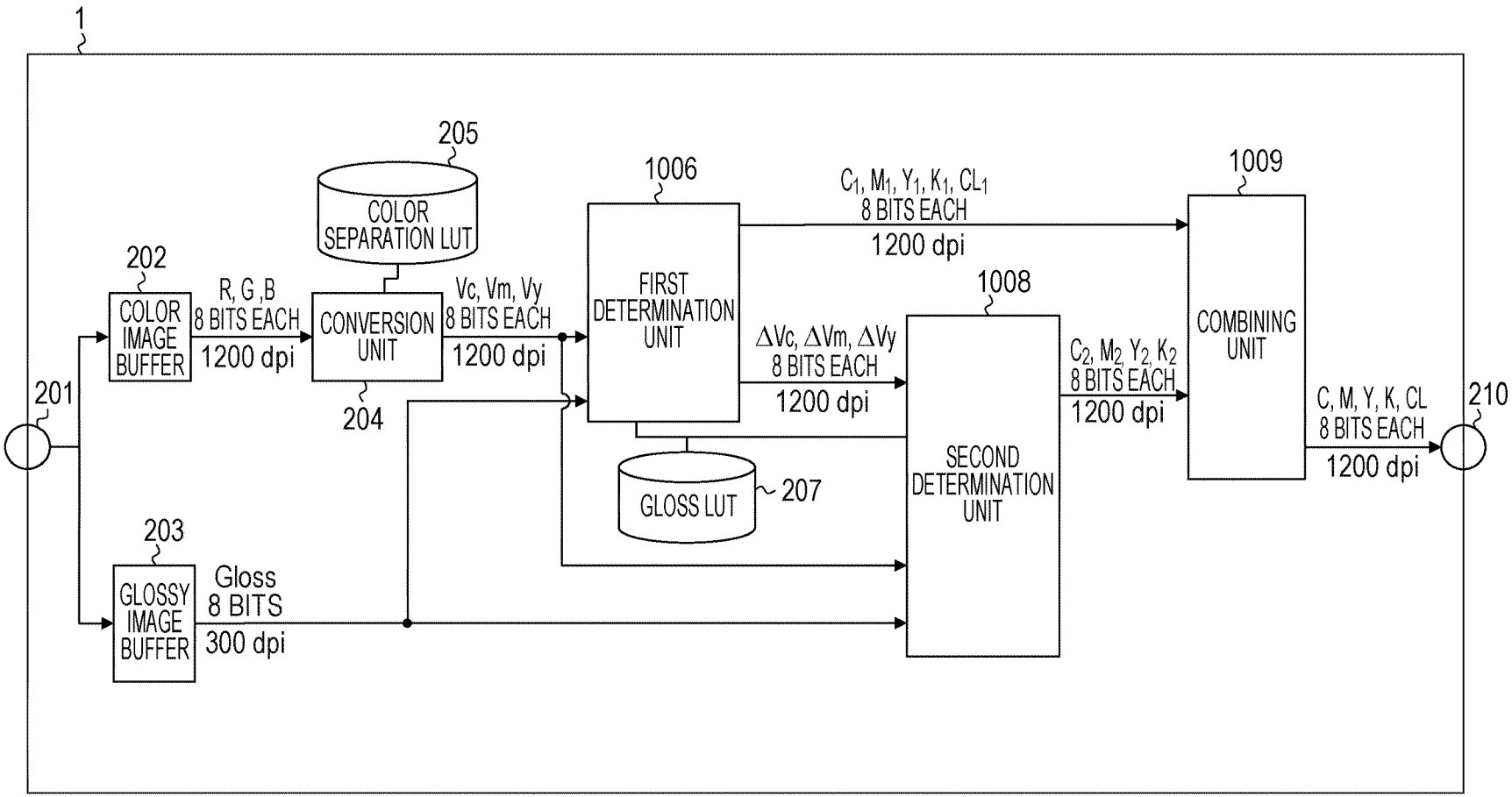
FIG. 10 is a block diagram illustrating a logical configuration of an image processing apparatus according to one or more aspects of the present disclosure.

FIG. 10 is a block diagram illustrating a logical configuration of an image processing apparatus 1 according to the third embodiment. Components 201, 202, 203, 204, 205, 207, and 210 included in the image processing apparatus 1 are the same as the first embodiment, and therefore, descriptions thereof are omitted. A first determination unit 1006, a second determination unit 1008, and a combining unit 1009 which are different from the first embodiment are mainly described.

Dot placement data representing ink dot placements determined by the first determination unit 1006 and the second determination unit 1008 is binary data representing whether an ink dot is to be recorded in a target pixel included in input color image data and is determined for each color of ink. Furthermore, in one or more aspects of the present disclosure, a dot placement is determined on the assumption of a multipass recording method for generating an image by performing recording scan eight times on a recording medium. Therefore, a dot placement is determined for each recording scan of each ink, and 40 patterns of dot placement are determined in total for five colors including C, M, Y, K, and CL, that is, eight patterns for each color.

Although a case where resolution of input color image data and resolution of dot placement data are the same as each other is described in one or more aspects of the present disclosure, resolution of dot placement data is not limited to the example. The resolution may be higher than that of the color image data as long as the resolution is expressed by a printer which records ink dots based on the dot placement data. The first determination unit 1006, the second determination unit 1008, and the combining unit 1009 will be described in detail hereinafter.

The first determination unit 1006 determines ink dot placements $H_{C1}$, $H_{M1}$, $H_{Y1}$, $H_{K1}$, and $H_{CL1}$ which determine whether ink dots are to be recorded in the first region based on the virtual ink amounts Vc, Vm, and Vy and the gloss signal Gloss. For simplicity of description, the maximum number of dots N_Max obtained by converting the maximum recording amount ink_Max into the number of dots is used as an ink amount limit.

As with the first embodiment, dot placement data of a clear ink is obtained based on the gloss signal Gloss with reference to the gloss LUT 207. Then a process of determining whether a target pixel is included in the first region based on the dot placement data and determining the ink dot placements $H_{C1}$, $H_{M1}$, $H_{Y1}$, $H_{K1}$, and $H_{CL1}$ is performed on the pixel determined as the first region.

In the process of determining the ink dot placements $H_{C1}$, $H_{M1}$, $H_{Y1}$, $H_{K1}$, and $H_{CL1}$, first, the number of dots of individual inks are sequentially obtained based on priority order of ink colors based on the virtual ink amounts Vc, Vm, and Vy and the gloss signal Gloss. The calculation of the numbers of dots is performed until the total value of dots exceeds the maximum number of dots N_Max or a process of converting recording amounts of all the ink colors into the numbers of dots is completed. As described above, the maximum number of dots N_Max is obtained by converting the maximum recording amount ink_Max into the number of dots (the number of dots of a recording material acceptable by a recording medium). The conversion into the number of dots is performed by uniformly distributing the maximum recording amount ink_Max to all the inks (C, M, Y, K, and CL) and performing a dot number calculation method described below on the distributed ink amounts. Furthermore, a method for determining the maximum dot number N_Max is not limited to the example described above. Similarly to the maximum recording amount ink_Max, the maximum dot number N_Max may be determined as follows. A chart including a patch of the numbers of recording dots in a plurality of standards is printed and the number of recording dots corresponding to the patch in which ink is not overflowed from a recording medium but penetrate and is fixed is determined as the maximum dot number N_Max. Furthermore, similarly to the maximum recording amount ink_Max, a plurality of maximum dot numbers N_Max may be stored for different recording media to be used for printing or different printing methods. The number of dots finally calculated is distributed for each recording scan.

In one or more aspects of the present disclosure, the number of dots is calculated on the CL ink and the achromatic K ink in this order. After the two types of ink are converted into the numbers of dots, a color ink corresponding to a largest one of the remaining virtual ink amounts Vc, Vm, and Vy is converted into the number of dots. Note that a description of a method for calculating the actual ink amounts C, M, Y, K, and CL using the gloss signal Gloss and the virtual ink amounts Vc, Vm, and Vy is omitted since the method is the same as that of the first embodiment.

Next, a method for converting an ink selected based on priority order into the number of dots will be described. Since color inks and a clear ink are separately recorded in two layers in one or more aspects of the present disclosure, an actual ink amount i of a selected ink is quantized so that a quantized number equal to or smaller than (p/2+1) is obtained (p denotes the number of times recording scan is performed). The quantized number obtained as a result of the quantization corresponds to the number of dots. Note that, when the number of layers for each separated ink is denoted by "Y", a maximum value of the quantized number is determined in accordance with the following expression: (p/Y+1). For example, as illustrated in FIG. 13B, in a case of three layers including a clear ink serving as a base, a color ink, and a clear ink serving as a top, 3 is assigned to Y and quantization is performed to obtain a quantized number equal to or smaller than (p/3+1).

Since the recording scan is performed eight times in one or more aspects of the present disclosure (the number of times recording scan is performed p=8), recording scan is performed four times in a first half using the color inks and recording scan is performed four times in a second half using the clear ink. Therefore, the individual inks are quantized to a value in a range from 0 to 4. Examples of results of the quantization obtained when the actual ink amount is denoted by "i" (i=C, M, Y, K, and CL) are represented by Expressions 7A to 7E. As described above, the results of the quantization are denoted by the numbers of dots Ni of the individual inks.

$N_i=0$ (i<51) Expression 7A $N_i=1$ (51≤i<102) Expression 7B $N_i=2$ (102≤i<153) Expression 7C $N_i=3$ (153≤i<204) Expression 7D $N_i=4$ (204≤i ) Expression 7E After the numbers of dots Ni of the selected inks are calculated, a total value of the calculated numbers of dots is compared with the maximum number of dots N_Max. The conversion into the numbers of dots in the first region is performed until the total value of dots exceeds the maximum number of dots N_Max or all the ink colors are converted into the numbers of dots. As described above, the virtual ink amounts Vc, Vm, and Vy which remain without being converted into the number of dots are supplied to the second determination unit 1008 as color difference information ΔVc, ΔVm, and ΔVy.

Next, a method for determining a dot layer by distributing the numbers of dots $N_C$, $N_M$, $N_Y$, $N_K$, and $N_{CL}$ of the inks are distributed for each recording scan will be described.

Among the numbers of dots of the inks, the numbers of dots $N_C$, $N_M$, $N_Y$, $N_K$ representing the color inks are distributed in accordance with Expressions 8A to 8E below. Specifically, dots of i ink (i=C, M, Y, and K) are distributed to recording scans 1 to 8 of the i ink (i_1 to i_8). As a result of the distribution, when the dots are to be recorded in the target pixel in each recording scan, 1 is recorded, and otherwise, 0 is recorded as a dot placement.

i_1 to i_8=0 ($N_i$ =0) Expression 8A i_1=1, i_2 to i_8=0 ($N_i$=1) Expression 8B i_1 to i_2=1, i_3 to i_8=0 ($N_i$ =2) Expression 8C i_1 to i_3=1, i_4 to i_8=0 ($N_i$ =3) Expression 8D i_1 to i_4=1, i_5 to i_8=0 ($N_i$ =4) Expression 8E Among the numbers of dots of the inks, the number of dots $N_{CL}$ representing the clear ink is distributed in accordance with Expressions 9A to 9E below. Specifically, dots of the CL ink are distributed to recording scans 1 to 8 of the CL ink (CL_1 to CL_8). As a result of the distribution, when the dots are to be recorded in the target pixel in each recording scan, 1 is recorded, and otherwise, 0 is recorded as a dot placement.

CL_1 to CL_8=0 ($N_{CL}$=0) Expression 9A

CL_1 to CL_7=0, CL_8=1 ($N_{CL}$=1) Expression 9B

CL_1 to CL_6=0, CL_7 to CL_8=1 ($N_{CL}$=2) Expression 9C

CL_1 to CL_5=0, CL_6 to CL_8=1 ($N_{CL}$=3) Expression 9D

CL_1 to CL_4=0, CL_5 to CL_8=1 ($N_{CL}$32 4) Expression 9E

As described above, different distribution methods are employed for the color inks and the clear ink. As a result, among the recording scan performed eight times in total, recording using the color inks is performed four times in a first half and the clear ink are performed four times in a second half. Since the recording scan is separately performed for each ink, an ink structure in which the clear ink is applied on the color inks may be realized as illustrated in FIG. 13A.

The dot placement in the first region may be determined by performing the processing control described above. Next, a method for determining a dot placement in the second region will be described.

The second determination unit 1008 determines dot placements $H_{C2}$, $H_{M2}$, $H_{Y2}$, and $H_{K2}$ of the inks which determine whether dots are to be recorded in the second region. Specifically, a dot placement is determined based on the color difference information ΔVc, ΔVm, and ΔVy calculated by the first calculator 206, in addition to the virtual ink amounts Vc, Vm, and Vy and the gloss signal Gloss.

In the process of determining dot placements $H_{C2}$, $H_{M2}$, $H_{Y2}$, and $H_{K2}$ of the inks, first, the virtual ink amounts Vc, Vm, and Vy are added to the color difference information ΔVc, ΔVm, and ΔVy. The total number of dots to be recorded in a target pixel is calculated based on the added virtual ink amounts and the gloss signal Gloss, and thereafter, the calculated total number of dots is distributed in each recording scan. A process of determining dot placements of the color inks in accordance with the virtual ink amounts Vc, Vm, and Vy is the same as the process performed by the first calculator 206 except for a target pixel, and therefore, a description thereof is omitted.

Figure 12B:
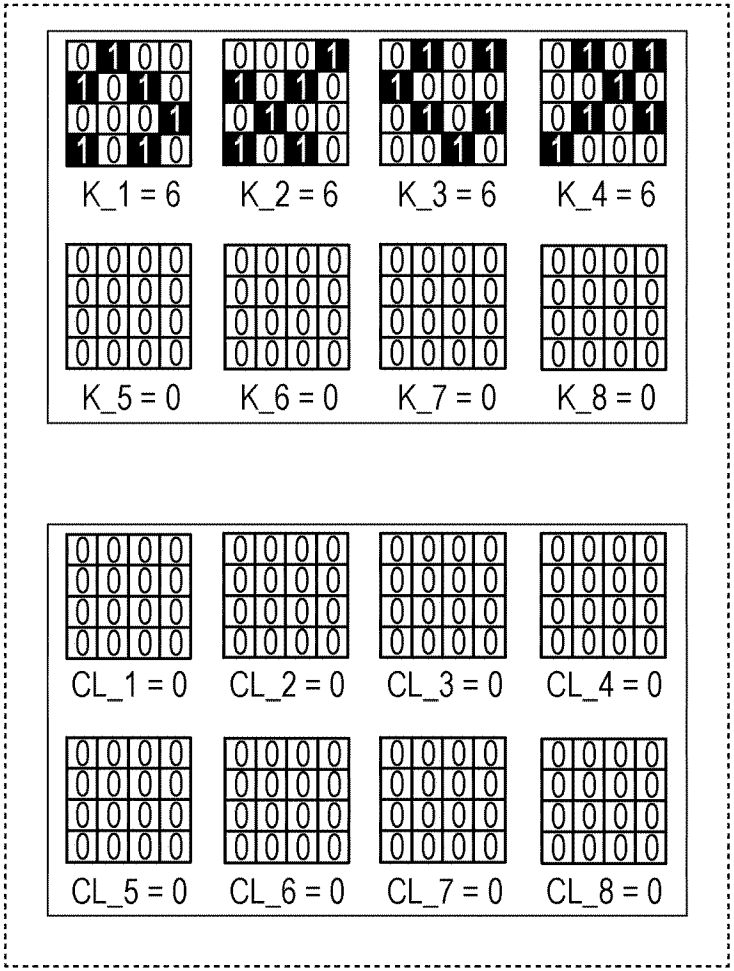
FIGS. 12A to 12C are diagrams schematically illustrating a dot placement according to one or more aspects of the present disclosure.
Figure 12A:
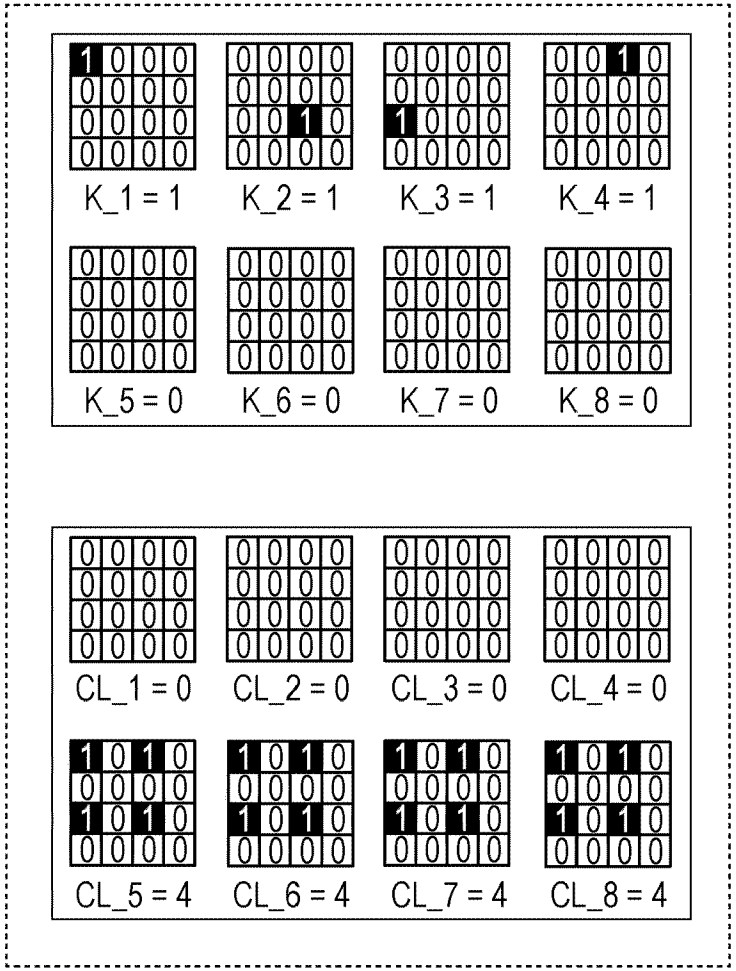
Figure 12C:
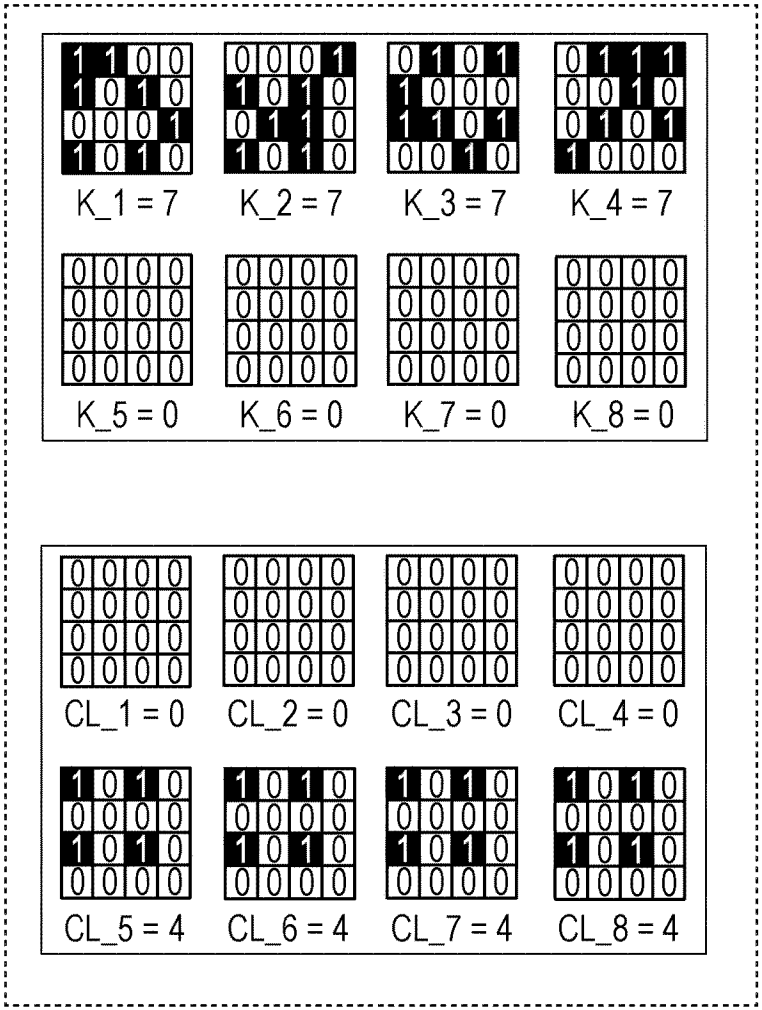

As with step S406 of the first embodiment, the combining unit 1009 adds and combines the dot placements $H_{C1}$, $H_{M1}$, $H_{Y1}$, $H_{K1}$, and $H_{CL1}$ of the input inks in the first region and the dot placements $H_{C2}$, $H_{M2}$, $H_{Y2}$, and $H_{K2}$ of the inks in the second region to each other. A result of the combining is a dot placement $H_C$, $H_M$, $H_Y$, $H_K$, and $H_{CL}$ of the inks corresponding to input data. FIG. 12A is a diagram illustrating dot placements $H_{K1}$ and $H_{CL1}$ in the first region, FIG. 12B is a diagram illustrating a dot placement $H_{K2}$ in the second region, and FIG. 12C is a diagram illustrating dot placements $H_K$ and $H_{CL}$ after the combining. A dot placement for each recording scan of an i ink is represented as follows.

By performing the processing control described above, in the process of determining a dot placement instead of the process of determining actual ink amounts, color differences generated in the first region are calculated and a dot placement in the second region is determined based on the calculated color differences and the corresponding color signals. As a result, enlargement of a gloss control range and reduction of color differences for each region may be realized, and both of reproduction of color and reproduction of gloss may be realized on a recording medium.

Note that, although the clear ink is used as the glossy ink in one or more aspects of the present disclosure as an example, the present disclosure is not limited to this, and a metallic ink may be used instead of the clear ink. Furthermore, a type of clear ink may be changed depending on an object included in an input image, content, or the like. Alternatively, a type of the clear ink may be selected in accordance with a gloss signal (gloss representing sharpness of gloss, gloss intensity representing intensity of gloss, or a glossy reflection direction representing a reflection direction of gloss).

Although the case where the number of times recording scan is performed is uniformly distributed to the color inks and the clear ink as an example in the foregoing embodiment, a distribution method is not limited to the example described above. Any method may be used as long as separation of inks to be used in recording is realized, and a ratio of the number of times recording scan of the color inks is performed may be increased if a color representation range of the color inks is emphasized.

According to the present disclosure, both of enlargement of a range in which gloss is reproduced and reduction of a color difference between color which is actually reproduced and color to be reproduced which occurs due to control of gloss may be realized.

In addition, the recording medium according to one or more aspects of the present disclosure may correspond to any type of medium/media providing storage and/or transmission of recording material, including but not limited to, writing, copying and printing paper, or the like, magnetic storage media (e.g., ROM, floppy disks, hard disks, universal serial busses (USBs), or the like), optical recording media, (e.g. CD-ROMs, DVDs, or the like), transmission media such as Internet hardware transmission media, or the like), measurable hardware structure including or carrying a signal or information, such as a device carrying a bitstream, a distributed hardware network, or the like, or any combination thereof.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors and one or more memories (e.g., central processing unit (CPU), micro processing unit (MPU), or the like) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, or the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2016-191587 filed Sep. 29, 2016, which is hereby incorporated by reference herein in its entirety.

What is claimed is:

1. An image processing apparatus which generates data for forming an image, the image processing apparatus comprising:

a first obtaining unit configured to obtain color signals representing colors of the image;

a second obtaining unit configured to obtain a gloss signal representing gloss of the image;

a third obtaining unit configured to obtain a predetermined amount of a recording material;

a first determination unit configured to determine a recording amount of glossy recording material to be recorded in a first region of the image based on the gloss signal;

a second determination unit configured to determine recording amounts of colored recording materials to be recorded in the first region based on the color signals such that a total amount of the recording amount of the glossy recording material to be recorded in the first region determined by the first determination unit and the recording amounts of the colored recording materials to be recorded in the first region does not exceed the predetermined amount; and a third determination unit configured to determine recording amounts of colored recording materials to be recorded in a second region of the image based on the color signals and the recording amounts of the colored recording materials determined by the second determination unit.

2. The image processing apparatus according to claim 1, further comprising:

a fourth obtaining unit configured to obtain a difference between color of an image represented by the colored recording materials of the recording amounts determined by the second determination unit in the first region and color of an image represented by the color signals, wherein the third determination unit determines a recording amount of the colored recording material to be recorded in the second region based on the color signals such that the difference obtained by the fourth obtaining unit is reduced.

3. The image processing apparatus according to claim 1, further comprising a fourth determination unit configured to determine whether each region in the image is the first region or the second region based on the gloss signal.

4. The image processing apparatus according to claim 3, further comprising:

a fifth obtaining unit configured to obtain dot placement data representing a dot placement of the glossy recording material on the recording medium based on the gloss signal, wherein the fourth determination unit determines whether each region in the image is the first region or the second region based on the dot placement data.

5. The image processing apparatus according to claim 4, further comprising:

a sixth obtaining unit configured to obtain a table in which the gloss signal and the dot placement data are associated with each other, wherein the fifth obtaining unit obtains the dot placement data based on the table.

6. The image processing apparatus according to claim 1, wherein the predetermined amount is an upper limit value of the recording amount of the recording material.

7. The image processing apparatus according to claim 1, wherein the colored recording materials are colored inks, and the glossy recording material is a clear ink.

8. The image processing apparatus according to claim 1, wherein the colored recording materials are colored inks, and the glossy recording material is a metallic ink.

9. The image processing apparatus according to claim 1, further comprising:

a generation unit configured to generate data for forming the image including the first region and the second region.

10. The image processing apparatus according to claim 9, further comprising:

an output unit configured to record the glossy recording material and the colored recording materials on the first region of the image, and to record the colored recording materials but not record the glossy recording material on the second region of the image, wherein the image is recorded on a recording medium.

11. The image processing apparatus according to claim 1, further comprising:

a conversion unit configured to convert the color signals into virtual recording amounts of virtual colored recording materials used to reproduce colors of the image represented by the color signals on the recording medium, wherein the second determination unit determines recording amounts of the colored recording materials to be recorded in the first region based on the virtual recording amounts.

12. The image processing apparatus according to claim 1, further comprising:

a calculation unit configured to calculate remaining amount of the recording amount of the recording material to be recorded in the first region by subtracting the recording amount of the glossy recording material determined by the first determination unit from the predetermined amount, wherein the second determination unit determines recording amounts of the colored recording materials to be recorded in the first region based on the remaining amount.

13. The image processing apparatus according to claim 1, wherein the gloss signal indicates one of or a combination of gloss image clarity gloss intensity, and a light reflection direction as gloss of the image.

14. The image processing apparatus according to claim 1, wherein the third determination unit determines recording amounts of the colored recording materials to be recorded in the second region by adding recording amounts of the colored recording materials for reproduction of colors represented by the differences on the recording medium to recording amounts of the colored recording materials for reproduction of colors represented by the color signals in the second region on the recording medium.

15. An image processing apparatus which generates data for forming an image, the image processing apparatus comprising:

a first obtaining unit configured to obtain color signals representing colors of the image;

a second obtaining unit configured to obtain a gloss signal representing gloss of the image;

a third obtaining unit configured to obtain a predetermined number of dots of a recording material;

a first determination unit configured to determine a number of dots of glossy recording material to be recorded in a first region of the image based on the gloss signal;

a second determination unit configured to determine a number of dots of colored recording materials to be recorded in the first region based on the color signals such that a total amount of the number of dots of the glossy recording material to be recorded in the first region determined by the first determination unit and the numbers of dots of the colored recording materials to be recorded in the first region does not exceed the predetermined number of dots;

a third determination unit configured to determine a number of dots of the colored recording materials to be recorded in a second region based on the color signals and the numbers of dots of the colored recording materials determined by the second determination unit.

16. The image processing apparatus according to claim 15, further comprising:

a generation unit configured to generate data for forming the image including the first region and the second region.

17. The image processing apparatus according to claim 16, further comprising:

an output unit configured to record the glossy recording material and the colored recording materials on the first region of the image, and to record the colored recording materials but not record the glossy recording material on the second region of the image, wherein the image is recorded on a recording medium.

18. An image processing method for generating data for forming an image, the image processing method comprising:

obtaining color signals representing colors of the image;

obtaining a gloss signal representing gloss of the image;

obtaining a predetermined amount of a recording material;

determining a recording amount of glossy recording material to be recorded in a first region of the image based on the gloss signal;

determining recording amounts of colored recording materials to be recorded in the first region based on the color signals such that a total amount of the determined recording amount of the glossy recording material to be recorded in the first region and the recording amounts of the colored recording materials to be recorded in the first region does not exceed a predetermined amount; and determining recording amounts of the colored recording materials to be recorded in a second region of the image based on the color signals and the determined recording amounts of the colored recording materials.

19. The image processing method according to claim 18, further comprising:

generating data for forming the image including the first region and the second region.

20. The image processing method according to claim 19, further comprising:

recording the glossy recording material and the colored recording materials on the first region of the image; and recording the colored recording materials but not record the glossy recording material on the second region of the image, wherein the image is recorded on a recording medium.

21. A non-transitory storage medium storing instructions that, when executed by a computer, cause the computer to perform a method comprising:

obtaining color signals representing colors of an image;

obtaining a gloss signal representing gloss of the image;

obtaining a predetermined amount of a recording material of the recording medium;

determining a recording amount of glossy recording material to be recorded in a first region of the image;

determining recording amounts of the colored recording materials to be recorded in the first region based on the color signals such that a total amount of the determined recording amount of the glossy recording material to be recorded in the first region and the recording amounts of the colored recording materials to be recorded in the first region does not exceed the predetermined amount; and determining recording amounts of the colored recording materials to be recorded in a second region of the image in which the glossy recording material is not recorded but the colored recording materials are recorded to form the image on the recording medium based on the color signals and the determined recording amounts of the colored recording materials.

22. The storage medium according to claim 21, wherein the method further comprises:

generating data for forming the image including the first region and the second region.

23. The storage medium according to claim 22, wherein the method further comprises:

recording the glossy recording material and the colored recording materials on the first region of the image; and recording the colored recording materials but not record the glossy recording material on the second region of the image, wherein the image is recorded on a recording medium.

* * * * *